US012662178B2

(12) United States Patent
Mallampati et al.

(10) Patent No.: US 12,662,178 B2
(45) Date of Patent: Jun. 23, 2026

(54) SYSTEM AND METHOD FOR OPTIMIZING UTILIZATION OF HOSTLER RESOURCES OF A HUB BASED ON A DUAL-STREAM RESOURCE OPTIMIZATION

(71) Applicant: BNSF Railway Company, Fort Worth, TX (US)

(72) Inventors: Dasaradh R. Mallampati, Trophy Club, TX (US); Vishal Badyal, Haslet, TX (US); Paul Kuhn, Fort Worth, TX (US); April Y. Kuo, Colleyville, TX (US)

(73) Assignee: BNSF Railway Company, Fort Worth, TX (US)

( * ) Notice: Subject to any disclaimer, the term of this patent is extended or adjusted under 35 U.S.C. 154(b) by 14 days.

(21) Appl. No.: 18/911,526

(22) Filed: Oct. 10, 2024

(65) Prior Publication Data

US 2025/0145195 A1 May 8, 2025

Related U.S. Application Data

(63) Continuation-in-part of application No. 18/501,608, filed on Nov. 3, 2023, now Pat. No. 12,217,199.

(51) Int. Cl.
*B61L 27/16* (2022.01)
*B61L 27/04* (2006.01)

(52) U.S. Cl.
CPC ..... *B61L 27/16* (2022.01); *B61L 27/04* (2013.01)

(58) Field of Classification Search
CPC ..... B61L 27/16; B61L 27/04; B61L 27/12; G06Q 2240/00; G06Q 10/04; G06Q 10/063; G06Q 10/08
See application file for complete search history.

(56) References Cited

U.S. PATENT DOCUMENTS 7,770,847 B1 * 8/2010 Severson ..... A63H 19/24 246/5
9,123,239 B2 9/2015 Kurzhanskiy
(Continued)

FOREIGN PATENT DOCUMENTS

CA 3153593 A1 3/2021
WO WO-2022012727 A1 * 1/2022 ..... G06Q 10/04
(Continued)

OTHER PUBLICATIONS

Tomas Liden, Coordinating maintenance windows and train trafc: a case study, Case Study and Applications, Accepted: Feb. 12, 2020 / Published online: Apr. 26, 2020. (Year: 2020).
(Continued)

*Primary Examiner* — Joseph J Dallo
(74) *Attorney, Agent, or Firm* — Whitaker Chalk Swindle & Schwartz PLLC; Enrique Sanchez, Jr.

(57) ABSTRACT

Systems and techniques for optimizing utilization of hostlers of a hub based on a dual-stream resource optimization (DSRO). In embodiments, a dual-stream optimization model is utilized, incorporating a consolidated time-space network and a deconsolidated time-space network spanning a planning horizon. The model identifies hostler operations and pairs them based on proximity criteria, forming operation pairs that lead to higher unit throughput within the hub. An optimized hostler operation schedule is generated for implementation during the planning horizon. The system also includes a feature for automatically transmitting a control signal to a hostler control system to direct a hostler to execute the paired operations in accordance with the pairing.

20 Claims, 8 Drawing Sheets

(56) References Cited

U.S. PATENT DOCUMENTS

| | | | | |
|---|---|---|---|---|
| 10,943,318 | B2 | 3/2021 | Benedict | |
| 2002/0082814 | A1 | 6/2002 | Doner | |
| 2002/0082893 | A1 | 6/2002 | Barts et al. | |
| 2004/0034556 | A1 | 2/2004 | Matheson | |
| 2004/0039597 | A1 | 2/2004 | Barts et al. | |
| 2005/0245974 | A1* | 11/2005 | Sherman | A61N 1/3904 600/518 |
| 2007/0156308 | A1 | 7/2007 | Muinonen | |
| 2014/0236957 | A1 | 8/2014 | Rieppi | |
| 2016/0342933 | A1 | 11/2016 | Johnson et al. | |
| 2017/0228566 | A1 | 8/2017 | Sengstaken, Jr. | |
| 2019/0287066 | A1 | 9/2019 | Kellaway, Jr. et al. | |
| 2021/0272065 | A1 | 9/2021 | Sakakibara et al. | |
| 2021/0398074 | A1 | 12/2021 | Bollapragada | |
| 2022/0319312 | A1* | 10/2022 | Mintz | G07B 15/063 |
| 2023/0007439 | A1 | 1/2023 | Williams et al. | |
| 2023/0028672 | A1 | 1/2023 | Oren et al. | |
| 2023/0088950 | A1 | 3/2023 | Tadeu de Paula et al. | |
| 2024/0317285 | A1 | 9/2024 | Malde | |
| 2024/0354635 | A1 | 10/2024 | Davaloo et al. | |
| 2025/0002062 | A1 | 1/2025 | Liu et al. | |

FOREIGN PATENT DOCUMENTS

| | | | | |
|---|---|---|---|---|
| WO | 2024025863 | A1 | 2/2024 | |
| WO | 2024049818 | A1 | 3/2024 | |
| WO | WO-2024105199 | A1 * | 5/2024 | G06Q 10/063 |

OTHER PUBLICATIONS

Heydari Ruhollah et al: "A path-based capacitated network flow model for empty railcar distribution", Annals of Operations Research, Springer US, New York, vol. 253, No. 2, Sep. 6, 2016 (Sep. 6, 2016), pp. 773-798, XP036260224, ISSN: 0254-5330, DOI: 10.1007/S10479-016-2259-4 [retrieved on Sep. 6, 2016].

Sarosky T et al: "Simulation of a Railroad Intermodal Terminal", Proceedings of the Winter Simulation Conference (WSC). Lake Buena Vista, Dec. 11-14, 1994; [Proceedings of the Winter Simulation Conference (WSC)], New York, IEEE, US, Dec. 11, 1994 (Dec. 11, 1994), pp. 1233-1238, XP000536746, ISBN: 978-0-7803-2109-0.

* cited by examiner

SYSTEM AND METHOD FOR OPTIMIZING UTILIZATION OF HOSTLER RESOURCES OF A HUB BASED ON A DUAL-STREAM RESOURCE OPTIMIZATION

CROSS-REFERENCE TO RELATED APPLICATIONS

The present application is a continuation-in-part of pending and co-owned U.S. patent application Ser. No. 18/501,608, entitled "SYSTEMS AND METHODS FOR INTERMODAL DUAL-STREAM-BASED RESOURCE OPTIMIZATION", filed Nov. 3, 2023, the entirety of which is herein incorporated by reference for all purposes.

TECHNICAL FIELD

The present disclosure relates generally to resource optimization systems, and more particularly to systems and devices for optimizing utilization of hostler resources of a hub based on a dual-stream resource optimization.

BACKGROUND

Intermodal transportation hubs are integral nodes in the global logistics network, facilitating the seamless transition of goods between different modes of transport such as rail, road, maritime, and aerial. These hubs are characterized by their ability to handle and process units that are designed for multi-modal transport. The operational context of an intermodal hub is complex and dynamic, involving a multitude of resources and processes.

One of the primary resources in an intermodal hub is the hostler, a specialized vehicle used for moving trailers within the hub. Hostlers play a pivotal role in maintaining the fluidity of operations within the hub. They are typically tasked with one operation at a time and are reassigned to the next operation upon completion. This form of scheduling is often referred to as myopic scheduling.

Another integral component of intermodal hub operations is the concept of ramping and deramping. Ramping refers to the process of loading units onto outbound trains, while deramping involves unloading units from inbound trains. These operations are typically performed by hostlers and are central to the flow of units through the hub.

The operations within an intermodal hub can be conceptualized as having two distinct operational sides: the ingating (IG) operational side, where units are dropped off by customers and stored in parking lots to wait for subsequent loading onto outbound trains, and the inbound (IB) operational side, where units arriving via inbound trains are unloaded and stored in parking lots to wait for customer pickup.

The management of these resources and operations is a complex task, requiring careful planning and coordination. The goal is to optimize the utilization of resources and maximize the throughput of units through the hub. This involves balancing the competing demands of different resources and operations, while also taking into account various operational constraints and limitations.

SUMMARY

The present disclosure achieves technical advantages as systems, methods, and computer-readable storage media for intelligently managing hostler operations to optimize operating schedules associated with a hub. In embodiments, the functionality to intelligently manage hostler operations to optimize operating schedules associated with a hub may include functionality for optimizing utilization of chassis resources of a hub based on a dual-stream resource optimization (DSRO). In embodiments, the present disclosure provides for a system integrated into a practical application with meaningful limitations as a hostler optimization system with functionality for optimizing utilization of hostler resources in a hub based on hostler operations intelligent management. In embodiments, intelligently managing hostler operations to optimize operating schedules associated with a hub may include identifying candidate ramp and deramp operations for pairing, such that the utilization of the hostler resources is optimized when the identified candidate ramp and deramp operations are paired. By pairing the operations, the optimized operating schedule, which includes recommendation for ramping and deramping operations, is optimized.

There are two particular pairing operations. A hostler operations optimization system may pair a deramp operation to a subsequent ramp operation. In this case, a hostler may be assigned to deramp a first unit from an inbound train and take it to an assigned parking spot (e.g., as recommended by the optimized operating schedule). A second unit that needs to be ramped onto an outbound train may be currently parked within a first threshold of the parking spot to which the first unit is assigned. In this case, the optimization system may optimize operations (e.g., may optimize the execution of the optimized operating schedule) by appending a hostler ramp operation that includes the hostler driving, after having dropped off the first unit on the assigned parking spot, to the parking spot in which the second unit is currently parked, pick up the second unit, drive it to the outbound train, and ramp it or load it onto the outbound train.

The hostler operations optimization system is particularly adept at executing two specific pairing operations. For example, the hostler operations optimization system may pair a deramp operation with a ramp operation, creating a seamless and efficient transition between the two hostler operations. For example, a hostler may be tasked with deramping a first unit from an inbound train and parking it at an assigned spot as per the optimized operating schedule. If a second unit, which requires ramping onto an outbound train, is parked within a close proximity to the first unit's parking spot, the system can optimize the hostler's route. This is achieved by appending a ramp operation to the hostler's tasks, allowing the hostler to drive directly from the parking spot of the first unit to the second unit, pick it up, and then proceed to ramp it onto the outbound train. In a similar manner, the hostler operations optimization system may pair a ramp operation with a deramp operation, creating a seamless and efficient transition between the two hostler operations. For example, a hostler may be tasked with ramping a first unit onto an outbound train. If a second unit, which requires deramping from an inbound train is located within a close proximity to the first unit's railcar, the system can optimize the hostler's route. This is achieved by appending a deramp operation to the hostler's ramp operation, allowing the hostler to drive directly from the railcar in which the first unit is ramped to the railcar from where the second unit is to be deramped.

There are several advantageous technical results that are realized through the features disclosed herein. For example, a system implemented in accordance with embodiments herein may realize enhanced efficiency in hostler resource utilization by minimizing unnecessary travel and idle time between operations, increased throughput of units within the hub due to streamlined hostler movements and reduced operational delays, improved execution of the optimized operating schedule by closely aligning actual hostler operations with the planned schedule, and optimization of the hub's overall operational workflow, leading to better service quality and customer satisfaction, among others. These technical improvements underscore the system's ability to not just automate but also intelligently manage hostler operations, resulting in a more efficient and productive hub environment.

Thus, it will be appreciated that the technological solutions provided herein, and missing from conventional systems, are more than a mere application of a manual process to a computerized environment, but rather include functionality to implement a technical process to replace or supplement current manual solutions or non-existing solutions for optimizing resources in hubs. In doing so, the present disclosure goes well beyond a mere application the manual process to a computer. Accordingly, the disclosure and/or claims herein necessarily provide a technological solution that overcomes a technological problem.

Furthermore, the functionality for intelligently managing hostler operations to optimize operating schedules associated with a hub provided by the present disclosure represents a specific and particular implementation that results in an improvement in the utilization of a computing system for resource optimization. Thus, rather than a mere improvement that comes about from using a computing system, the present disclosure, in enabling a system to leverage and optimize hostler operations to optimize the execution of the optimized operating schedule, represents features that result in a computing system device that can be used more efficiently and is improved over current systems that do not implement the functionality described herein. As such, the present disclosure and/or claims are directed to patent eligible subject matter.

In various embodiments, a system may comprise one or more processors interconnected with a memory module, capable of executing machine-readable instructions. These instructions include, but are not limited to, instruction configured to implement the steps outlined in any flow diagram, system diagram, block diagram, and/or process diagram disclosed herein, as well as steps corresponding to a computer program process for implementing any functionality detailed herein, whether or not described with reference to a diagram. However, in typical implementations, implementing features of embodiments of the present disclosure in a computing system may require executing additional program instructions, which may slow down the computing system's performance. To address this problem, the present disclosure includes features that integrate parallel-processing functionality to enhance the solution described herein.

In embodiments, the parallel-processing functionality of systems of embodiments may include executing the machine-readable instructions implementing features of embodiments of the present disclosure by initiating or spawning multiple concurrent computer processes. Each computer process may be configured to execute, process or otherwise handle a designated subset or portion of the machine-readable instructions specific to the disclosure's functionalities. This division of tasks enables parallel processing, multi-processing, and/or multi-threading, allowing multiple operations to be conducted or executed concurrently rather than sequentially. By integrating this parallel-processing functionality into the solution described in the present disclosure, a system markedly increases the overall speed of executing the additional instructions required by the features described herein. This not only mitigates any potential slowdown but also enhances performance beyond traditional systems. Leveraging parallel or concurrent processing substantially reduces the time required to complete sets or subsets of program steps when compared to execution without such processing. This efficiency gain accelerates processing speed and optimizes the use of processor resources, leading to improved performance of the computing system. This enhancement in computational efficiency constitutes a significant technological improvement, as it enhances the functional capabilities of the processors and the system as a whole, representing a practical and tangible technological advancement. The integration of parallel-processing functionality into the features of the present disclosure results in an improvement in the functioning of the one or more processors and/or the computing system, and thus, represents a practical application.

In embodiments, the present disclosure includes techniques for training models (e.g., machine-learning models, artificial intelligence models, algorithmic constructs, etc.) for performing or executing a designated task or a series of tasks (e.g., one or more features of steps or tasks of processes, systems, and/or methods disclosed in the present disclosure). The disclosed techniques provide a systematic approach for the training of such models to enhance performance, accuracy, and efficiency in their respective applications. In embodiments, the techniques for training the models may include collecting a set of data from a database, conditioning the set of data to generate a set of conditioned data, and/or generating a set of training data including the collected set of data and/or the conditioned set of data. In embodiments, that model may undergo a training phase wherein the model may be exposed to the set of training data, such as through an iterative processes of learning in which the model adjusts and optimizes its parameters and algorithms to improve its performance on the designated task or series of tasks. This training phase may configure the model to develop the capability to perform its intended function with a high degree of accuracy and efficiency. In embodiments, the conditioning of the set of data may include modification, transformation, and/or the application of targeted algorithms to prepare the data for training. The conditioning step may be configured to ensure that the set of data is in an optimal state for training the model, resulting in an enhancement of the effectiveness of the model's learning process. These features and techniques not only qualify as patent-eligible features but also introduce substantial improvements to the field of computational modeling. These features are not merely theoretical but represent an integration of a concepts into a practical application that significantly enhance the functionality, reliability, and efficiency of the models developed through these processes.

In embodiments, the present disclosure includes techniques for generating a notification of an event that includes generating an alert that includes information specifying the location of a source of data associated with the event, formatting the alert into data structured according to an information format, and/or transmitting the formatted alert over a network to a device associated with a receiver based upon a destination address and a transmission schedule. In embodiments, receiving the alert enables a connection from the device associated with the receiver to the data source over the network when the device is connected to the source to retrieve the data associated with the event and causes a viewer application (e.g., a graphical user interface (GUI)) to be activated to display the data associated with the event. These features represent patent eligible features, as these features amount to significantly more than an abstract idea. These features, when considered as an ordered combination, amount to significantly more than simply organizing and comparing data. The features address the Internet-centric challenge of alerting a receiver with time sensitive information. This is addressed by transmitting the alert over a network to activate the viewer application, which enables the connection of the device of the receiver to the source over the network to retrieve the data associated with the event. These are meaningful limitations that add more than generally linking the use of an abstract idea (e.g., the general concept of organizing and comparing data) to the Internet, because they solve an Internet-centric problem with a solution that is necessarily rooted in computer technology. These features, when taken as an ordered combination, provide unconventional steps that confine the abstract idea to a particular useful application. Therefore, these features represent patent eligible subject matter.

In embodiments, one or more operations and/or functionality of components described herein can be distributed across a plurality of computing systems (e.g., personal computers (PCs), user devices, servers, processors, etc.), such as by implementing the operations over a plurality of computing systems. This distribution can be configured to facilitate the optimal load balancing of traffic (e.g., requests, responses, notifications, etc.), which can encompass a wide spectrum of network traffic or data transactions. By leveraging a distributed operational framework, a system implemented in accordance with embodiments of the present disclosure can effectively manage and mitigate potential bottlenecks, ensuring equitable processing distribution and preventing any single device from shouldering an excessive burden. This load balancing approach significantly enhances the overall responsiveness and efficiency of the network, markedly reducing the risk of system overload and ensuring continuous operational uptime. The technical advantages of this distributed load balancing can extend beyond mere efficiency improvements. It introduces a higher degree of fault tolerance within the network, where the failure of a single component does not precipitate a systemic collapse, markedly enhancing system reliability. Additionally, this distributed configuration promotes a dynamic scalability feature, enabling the system to adapt to varying levels of demand without necessitating substantial infrastructural modifications. The integration of advanced algorithmic strategies for traffic distribution and resource allocation can further refine the load balancing process, ensuring that computational resources are utilized with optimal efficiency and that data flow is maintained at an optimal pace, regardless of the volume or complexity of the requests being processed. Moreover, the practical application of these disclosed features represents a significant technical improvement over traditional centralized systems. Through the integration of the disclosed technology into existing networks, entities can achieve a superior level of service quality, with minimized latency, increased throughput, and enhanced data integrity. The distributed approach of embodiments can not only bolster the operational capacity of computing networks but can also offer a robust framework for the development of future technologies, underscoring its value as a foundational advancement in the field of network computing.

To aid in the load balancing, the computing system of embodiments of the present disclosure can spawn multiple processes and threads to process data traffic concurrently. The speed and efficiency of the computing system can be greatly improved by instantiating more than one process or thread to implement the claimed functionality. However, one skilled in the art of programming will appreciate that use of a single process or thread can also be utilized and is within the scope of the present disclosure.

It is an object of the disclosure to provide a method of intelligently managing hostler operations to optimize operating schedules associated with a hub. It is a further object of the disclosure to provide a system for intelligently managing hostler operations to optimize operating schedules associated with a hub, and a computer-based tool intelligently managing hostler operations to optimize operating schedules associated with a hub. These and other objects are provided by the present disclosure, including at least the following embodiments.

In one particular embodiment, a method of intelligently managing hostler operations to optimize operating schedules associated with a hub is provided. The method includes determining, using a dual-stream optimization model including a consolidated time-space network and a deconsolidated time-space network over a planning horizon of an optimized operating schedule, one or more hostler operations to be performed at time increments of the planning horizon, identifying a first hostler operation to be performed during a first time increment of the planning horizon, the first hostler operation having a route terminating at an end-point, identifying a second hostler operation to be performed during the first time increment of the planning horizon, the second hostler operation having a route beginning at a start-point, determining whether the end-point of the first hostler operation is within a threshold distance of the start-point of the second hostler operation, pairing, in response to a determination that the end-point of the first hostler operation is within a threshold distance of the start-point of the second hostler operation, the first hostler operation to the second hostler operation to include a paired hostler operation in the optimized operating schedule that includes performing, by a hostler, the second hostler operation after the first hostler operation without the hostler detouring from traveling from the end-point to the start-point, and automatically sending, during execution of the optimized operating schedule, a control signal to a controller to cause the hostler to execute the paired hostler operation during the first time increment.

In another embodiment, a system for intelligently managing hostler operations to optimize operating schedules associated with a hub is provided. The system comprises at least one processor and a memory operably coupled to the at least one processor and storing processor-readable code that, when executed by the at least one processor, is configured to perform operations. The operations include determining, using a dual-stream optimization model including a consolidated time-space network and a deconsolidated time-space network over a planning horizon of an optimized operating schedule, one or more hostler operations to be performed at time increments of the planning horizon, identifying a first hostler operation to be performed during a first time increment of the planning horizon, the first hostler operation having a route terminating at an end-point, identifying a second hostler operation to be performed during the first time increment of the planning horizon, the second hostler operation having a route beginning at a start-point, determining whether the end-point of the first hostler operation is within a threshold distance of the start-point of the second hostler operation, pairing, in response to a determination that the end-point of the first hostler operation is within a threshold distance of the start-point of the second hostler operation, the first hostler operation to the second hostler operation to include a paired hostler operation in the optimized operating schedule that includes performing, by a hostler, the second hostler operation after the first hostler operation without the hostler detouring from traveling from the end-point to the start-point, and automatically sending, during execution of the optimized operating schedule, a control signal to a controller to cause the hostler to execute the paired hostler operation during the first time increment.

In yet another embodiment, a computer-based tool for intelligently managing hostler operations to optimize operating schedules associated with a hub is provided. The computer-based tool including non-transitory computer readable media having stored thereon computer code which, when executed by a processor, causes a computing device to perform operations. The operations include determining, using a dual-stream optimization model including a consolidated time-space network and a deconsolidated time-space network over a planning horizon of an optimized operating schedule, one or more hostler operations to be performed at time increments of the planning horizon, identifying a first hostler operation to be performed during a first time increment of the planning horizon, the first hostler operation having a route terminating at an end-point, identifying a second hostler operation to be performed during the first time increment of the planning horizon, the second hostler operation having a route beginning at a start-point, determining whether the end-point of the first hostler operation is within a threshold distance of the start-point of the second hostler operation, pairing, in response to a determination that the end-point of the first hostler operation is within a threshold distance of the start-point of the second hostler operation, the first hostler operation to the second hostler operation to include a paired hostler operation in the optimized operating schedule that includes performing, by a hostler, the second hostler operation after the first hostler operation without the hostler detouring from traveling from the end-point to the start-point, and automatically sending, during execution of the optimized operating schedule, a control signal to a controller to cause the hostler to execute the paired hostler operation during the first time increment.

The foregoing has outlined rather broadly the features and technical advantages of the present disclosure in order that the detailed description of the disclosure that follows may be better understood. Additional features and advantages of the disclosure will be described hereinafter which form the subject of the claims of the disclosure. It should be appreciated by those skilled in the art that the conception and specific embodiment disclosed may be readily utilized as a basis for modifying or designing other structures for carrying out the same purposes of the present disclosure. It should also be realized by those skilled in the art that such equivalent constructions do not depart from the spirit and scope of the disclosure as set forth in the appended claims. The novel features which are believed to be characteristic of the disclosure, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present disclosure.

BRIEF DESCRIPTION OF THE DRAWINGS

For a more complete understanding of the present disclosure, reference is now made to the following descriptions taken in conjunction with the accompanying drawings, in which.

Figure 1:
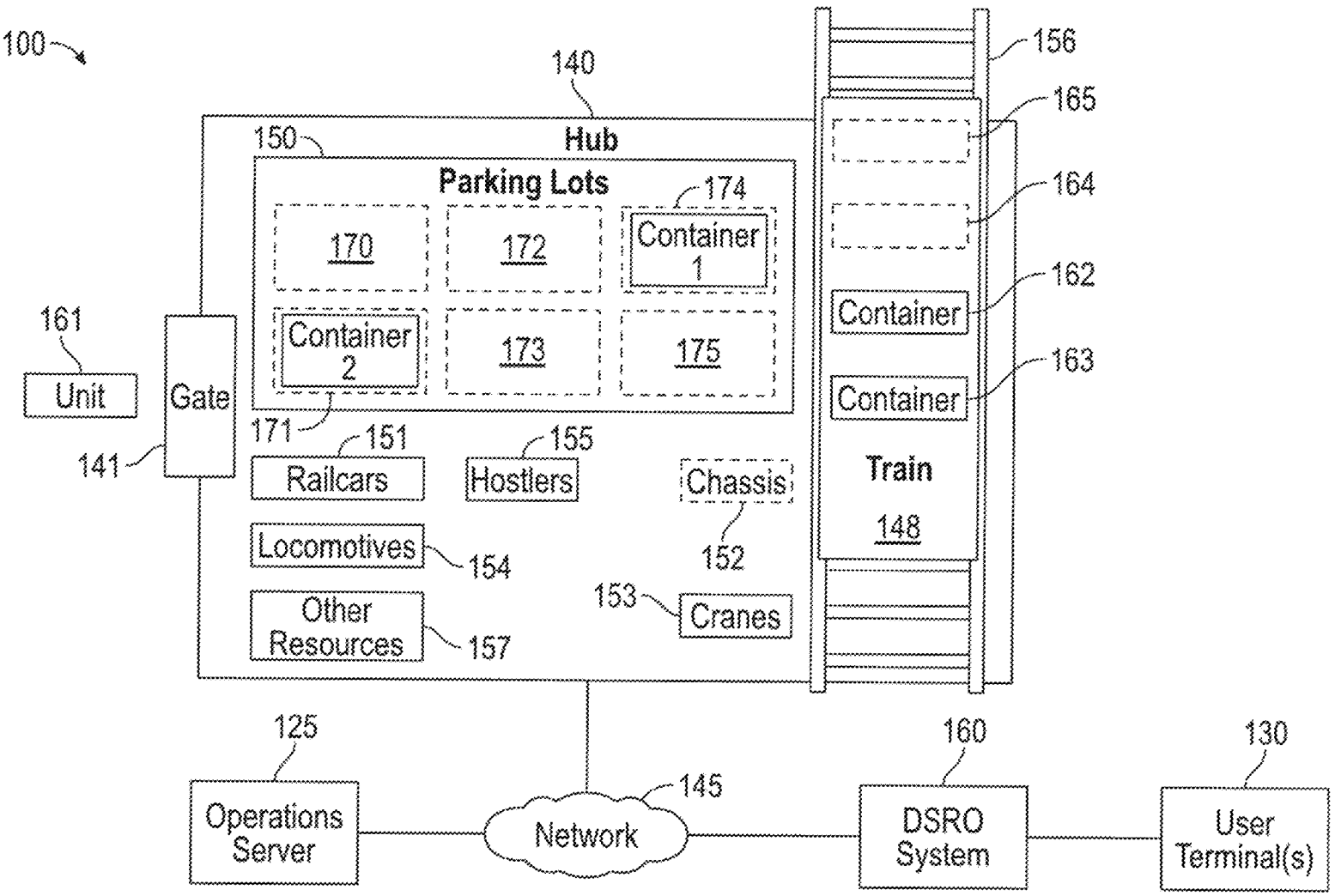
FIG. 1 is a block diagram of an exemplary system configured with capabilities and functionality for intelligently managing hostler operations to optimize operating schedules associated with a hub in accordance with embodiments of the present disclosure.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION

The disclosure presented in the following written description and the various features and advantageous details thereof, are explained more fully with reference to the non-limiting examples included in the accompanying drawings and as detailed in the description. Descriptions of well-known components have been omitted to not unnecessarily obscure the principal features described herein. The examples used in the following description are intended to facilitate an understanding of the ways in which the disclosure can be implemented and practiced. A person of ordinary skill in the art would read this disclosure to mean that any suitable combination of the functionality or exemplary embodiments below could be combined to achieve the subject matter claimed. The disclosure includes either a representative number of species falling within the scope of the genus or structural features common to the members of the genus so that one of ordinary skill in the art can recognize the members of the genus. Accordingly, these examples should not be construed as limiting the scope of the claims.

A person of ordinary skill in the art would understand that any system claims presented herein encompass all of the elements and limitations disclosed therein, and as such, require that each system claim be viewed as a whole. Any reasonably foreseeable items functionally related to the claims are also relevant. The Examiner, after having obtained a thorough understanding of the disclosure and claims of the present application has searched the prior art as disclosed in patents and other published documents, i.e., nonpatent literature. Therefore, the issuance of this patent is evidence that: the elements and limitations presented in the claims are enabled by the specification and drawings, the issued claims are directed toward patent-eligible subject matter, and the prior art fails to disclose or teach the claims as a whole, such that the issued claims of this patent are patentable under the applicable laws and rules of this country.

Various embodiments of the present disclosure are directed to systems and techniques that provide functionality for intelligently managing hostler operations to optimize operating schedules associated with a hub. In embodiments, the functionality to intelligently manage hostler operations to optimize operating schedules associated with a hub may include functionality for optimizing utilization of chassis resources of a hub based on a dual-stream resource optimization (DSRO). In embodiments, the present disclosure provides for a system integrated into a practical application with meaningful limitations as a hostler optimization system with functionality for optimizing utilization of hostler resources in a hub based on hostler operations intelligent management. In embodiments, intelligently managing hostler operations to optimize operating schedules associated with a hub may include identifying candidate ramp and deramp operations for pairing, such that the utilization of the hostler resources is optimized when the identified candidate ramp and deramp operations are paired. By pairing the operations, the optimized operating schedule, which includes recommendation for ramping and deramping operations, is optimized.

FIG. 1 is a block diagram of an exemplary system 100 configured with capabilities and functionality for optimizing utilization of chassis resources of a hub based on a DSRO in accordance with embodiments of the present disclosure. As shown in FIG. 1, system 100 may include user terminal 130, hub 140, network 145, operations server 125, and DSRO system 160. These components, and their individual components, may cooperatively operate to provide functionality in accordance with the discussion herein.

It is noted that the functional blocks, and components thereof, of system 100 of embodiments of the present disclosure may be implemented using processors, electronics devices, hardware devices, electronics components, logical circuits, memories, software codes, firmware codes, etc., or any combination thereof. For example, one or more functional blocks, or some portion thereof, may be implemented as discrete gate or transistor logic, discrete hardware components, or combinations thereof configured to provide logic for performing the functions described herein. Additionally, or alternatively, when implemented in software, one or more of the functional blocks, or some portion thereof, may comprise code segments operable upon a processor to provide logic for performing the functions described herein.

It is also noted that various components of system 100 are illustrated as single and separate components. However, it will be appreciated that each of the various illustrated components may be implemented as a single component (e.g., a single application, server module, etc.), may be functional components of a single component, or the functionality of these various components may be distributed over multiple devices/components. In such embodiments, the functionality of each respective component may be aggregated from the functionality of multiple modules residing in a single, or in multiple devices.

It is further noted that functionalities described with reference to each of the different functional blocks of system 100 described herein is provided for purposes of illustration, rather than by way of limitation and that functionalities described as being provided by different functional blocks may be combined into a single component or may be provided via computing resources disposed in a cloud-based environment accessible over a network, such as one of network 145.

User terminal 130 may include a mobile device, a smartphone, a tablet computing device, a personal computing device, a laptop computing device, a desktop computing device, a computer system of a vehicle, a personal digital assistant (PDA), a smart watch, another type of wired and/or wireless computing device, or any part thereof. In embodiments, user terminal 130 may provide a user interface that may be configured to provide an interface (e.g., a graphical user interface (GUI)) structured to facilitate an operator interacting with system 100, e.g., via network 145, to execute and leverage the features provided by server 110. In embodiments, the operator may be enabled, e.g., through the functionality of user terminal 130, to provide functionality for managing operations of hub 140 in accordance with embodiments of the present disclosure. For example, an operator may provide information related to train schedules, information related to units arriving at hub 140, information related to configuration of the parking lots within hub 140, information related to production track configurations, to request parking spot assignments, etc. In an additional or alternative example, the operator may receive information related to parking spot assignments for units, such as may receive parking spot assignments, may receive multihop move orders, etc. In embodiments, user terminal 130 may be configured to communicate with other components of system 100.

In embodiments, network 145 may facilitate communications between the various components of system 100 (e.g., hub 140, DSRO system 160, and/or user terminal 130). Network 145 may include a wired network, a wireless communication network, a cellular network, a cable transmission system, a Local Area Network (LAN), a Wireless LAN (WLAN), a Metropolitan Area Network (MAN), a Wide Area Network (WAN), the Internet, the Public Switched Telephone Network (PSTN), etc.

Hub 140 may represent a hub (e.g., an IHF, a train station, etc.) in which units are processed as part of the transportation of the units. In embodiments, a unit may include containers, trailers, etc., carrying goods. For example, a unit may include a chassis carrying a container, and/or may include a container. In embodiments, units may be in-gated (IG) into hub 140 (e.g., by a customer dropping the unit into hub 140). The unit, including the chassis and the container (e.g., the chassis carrying the container), may be temporarily stored in a parking space of parking lots 150, while the container awaits being assigned to an outbound train. Once assigned to an outbound train, and once the outbound train is assigned to a production track (e.g., production tracks 156), the outbound train is placed on the production track and the container is moved from the parking spot in which the container is currently stored to the production track, where the container is removed from the chassis and the container is loaded or ramped onto the outbound train for transportation to the destination of the container. On the other side of operations, a container carrying goods may arrive at the hub via an inbound (IB) train (e.g., the IB train may represent an outbound train from another hub from which the container may have been loaded), may be unloaded or deramped from the IB train and may be temporarily stored in a parking spot of parking lots 150 for eventual pickup by a customer.

Hub 140 may be described functionally by describing the operations of hub 140 as comprising two distinct flows or streams. Units (e.g., containers being carried in chassis) flowing through a first flow (e.g., an IG flow) may be received through gate 141 from various customers for eventual ramping onto an appropriate outbound train. For example, customers may drop off individual units (e.g., unit 161 including a container being carried in a chassis) at hub 140. The containers arriving through the IG flow may be destined for different destinations, and may be dropped off at hub 140 at various times of the day or night. As part of the IG flow, the containers arriving at hub 140, along with the chassis in which these containers arrive, may be assigned or allocated to parking spots in one or more of parking lots 150, while these containers wait to be assigned to and ramped onto an outbound train bound to the respective destination of the containers. Once an outbound train is ready to be ramped, the outbound train (e.g., train 148) may be assigned to and placed on a production track (e.g., production track 156). At this point, the containers assigned to the outbound train may be moved from their current parking spot to the production track to be ramped onto the outbound train to be taken to their respective destination.

Units flowing through a second flow (e.g., an IB flow) may arrive at hub 140 via an IB train (e.g., train 148 may arrive at hub 140), carrying containers, such as containers 162, 163, and/or other containers, which may eventually be deramped from the inbound train to be placed onto chassis, assigned to and parked in parking spots of parking lot 150 to be made available for delivery to (e.g., for pickup by) customers.

For example, unit 141, including a container being carried in a chassis, may be currently being dropped off into hub 140 by a customer as part of the IG flow of hub 140, and may be destined to a first destination. In this case, as part of the IG flow, unit 141 may be in-gated into hub 140 and may be assigned to a parking spot (e.g., parking spot 175) in one of parking lots 150. In this example, container 1 may have been introduced into the IG flow of hub 140 by a customer (e.g., the same customer or a different customer) previously dropping off container 1 at hub 140 to be transported to some destination (e.g., the first destination or a different destination), and may have previously been assigned to parking spot 174 of parking lots 150, where container 1 may currently be waiting to be assigned and/or loaded onto an outbound train to be transported to the destination of container 1.

As part of the IG flow, the container in unit 141 and container 1 may be assigned to an outbound train. For example, in this particular example, train 148 may represent an outbound train that is schedule to depart hub 140 to the same destination as the container in unit 141 and container 1. In this example, the container in unit 141 and container 1 may be assigned to train 148. Train 148 may be placed on one of one or more production track 156 to be ramped. In this case, as part of the IG flow, train 148 is ramped (e.g., using one or more cranes 153) with containers, including the container in unit 141 and container 1. Once loaded, train 148 may depart to its destination as part of the IG flow.

With respect to the IB flow, train 148 may arrive at hub 140 carrying several containers, including containers 2, 162, and 163. It is noted that, as part of the dual stream operations of hub 140, some resources are shared and, in this example, train 148 may arrive at hub 140 as part of the IB flow before being loaded with containers as part of the IG flow as described above. Train 148 may be placed on one of one or more production tracks 156 to be unloaded a part of the IB flow. As part of the deramping operations, the containers being carried by train 148 and destined for hub 140, may be removed from train 148 (e.g., using one or more cranes 153) and each placed or mounted on a chassis. Once on the chassis, the containers are transported (e.g., using one or more hostlers 155) to an assigned parking spot of parking lots 150 to wait to be picked up by respective customers at which point the containers and the chassis on which the containers are mounted may exit or leave hub 140. For example, container 2 may be assigned to and parked on parking spot 172.

In embodiments, processing the units through the IG flow and the IB flow may involve the use of a wide variety of resources to consolidate the units from customers into outbound trains and/or to deconsolidate inbound trains into units for delivery to customers. These resources may include hub personnel (hostler drivers, crane operators, etc.), parking spaces, chassis, hostlers, cranes, tracks, railcars, locomotives, etc. These resources may be used to facilitate holding and/or moving the units through the operations of the hub.

For example, parking lots 150 may be used to park or store units while the units are waiting to be assigned to and loaded onto outbound trains or waiting to be picked up by customers. Parking lots 150 of hub 140 may include a plurality of parking lots, each of which may include a plurality of parking spots. In the example illustrated in FIG. 1, parking lots may include parking spots 170-175. In embodiments, parking lots 150 may represent physical parking lots that may be configured with a particular layout, orientation with respect to the production tracks of hub 140, and/or distance from the production tracks. In some embodiments, the various parking lots of parking lots 150 may have different categories, based on the accessibility to the production tracks 156 from the respective parking lots. For example, some parking lots may be categorized as beachfront parking lots, high-priority hub parking lots, low-priority hub parking lots, offsite parking lots, stacked parking lots, etc. During operations, units arriving at hub 140 may be allocated to parking lot categories, in which case a unit allocated to a particular parking lot category may be assigned to a parking spot in a parking lot having the allocated particular parking lot category.

Chassis 152 (e.g., including, trucks, forklifts, and/or any structure configured to securely carry a container), and operators of chassis 152, may be used to securely carry units within hub 140. Hostlers 155 (e.g., including hostler operators, etc.) may be used to transport or move the units (e.g., containers on chassis) within hub 140, such as moving units to be loaded onto an outbound train or to move units unloaded from inbound trains. Cranes 153 may be used to load units onto departing trains (e.g., to unload units from chassis 152 and load the units onto the departing trains), and/or to unload units from arriving trains (e.g., e.g., to unload units from arriving trains and load the units onto chassis 152). Railcars 151 may be used to transport the units in the train. For example, a train may be composed of one or more railcars, and the units may be loaded onto the railcars for transportation. Arriving trains may include one or more railcars including units that may be processed through the second flow, and departing trains may include one or more railcars including units that may have been processed through the first flow. Railcars 151 may be assembled together to form a train. Locomotives 154 may include engines that may be used to power a train. Other resources 157 may include other resources not explicitly mentioned herein but configured to allow or facilitate units to be processed through the first flow and/or the second flow.

In embodiments, operations server 125 may be configured to provide functionality for facilitating operations of hub 140. In embodiments, operations server 125 may include data and information related to operations of hub 140, such as current inventory of all hub resources (e.g., chassis, hostlers, drivers, lift capacity, parking lot and parking spaces, IG capacity limits, railcar, locomotives, tracks, etc.). This hub resource information included in operations server 125 may change over time as resources are consumed, replaced, and/or replenished, and operations server 125 may have functionality to update the information. Operations server 125 may include data and information related to inbound and/or outbound train schedules (e.g., arriving times, departure times, destinations, origins, capacity, available spots, inventory list of units arriving in inbound trains, etc.). In particular, inbound train schedules may provide information related to inbound trains that are scheduled to arrive at the hub during the planning horizon an optimized operating schedule (as described herein), which may include scheduled arrival time, origin of the inbound train, capacity of the inbound train, a list of units loaded onto the inbound train, a list of units in the inbound train destined for the hub (e.g., to be dropped off at the hub), etc. With respect to outbound train schedules, the outbound train schedules may provide information related to outbound trains that are scheduled to depart from the hub during the planning horizon, including scheduled departure time, capacity of the outbound train, a list of units already scheduled to be loaded onto the outbound train, destination of the outbound train, etc. In embodiment, the information from operations server 125 may be used (e.g., by DSRO system 160) to develop, generate, and/or update an optimized operating schedule based on a DSRO for managing the resources of hub 140 over a planning horizon.

In embodiments, operations server 125 may provide functionality to manage the execution of the optimized operational schedule (e.g., an optimized operating schedule generated in accordance with embodiments of the present disclosure) over the planning horizon of the optimized operating schedule. The optimized operating schedule may represent recommendations made by DSRO system 160 of how units arriving at each time increment of the planning horizon are to be processed, and how resources of hub 140 are to be managed to maximize unit throughput through the hub over the planning horizon of the optimized operating schedule. Particular to the present disclosure, the optimized operating schedule may include recommendations associated with the utilization of hostler resources for performing ramping and deramping operations. For example, the optimized operating schedule may include recommendations on which and how units are to be ramped or deramped from inbound or to outbound trains.

In embodiments, operations server 125 may manage execution of the optimized operational schedule by monitoring the consolidation stream operations flow (e.g., consolidation stream operations flow 116 of FIG. 2, which may represent the actual unit traffic flow through the IG flow during execution of the optimized operating schedule) and deconsolidation stream operations flow (e.g., deconsolidation stream operations flow 118 of FIG. 2, which may represent the actual unit traffic flow through the IB flow during execution of the optimized operating schedule) to ensure that the optimized operational schedule is being executed properly, and to update the optimized operating schedule based on the actual unit traffic, which may impact resource availability and/or consumption, especially when the actual unit traffic during execution of the optimized operational schedule differs from the predicted unit traffic used in the generation of the optimized operational schedule. In embodiments, operations server 125 may operate to provide functionality that may be leveraged during execution of the optimized operational schedule over a planning horizon to ensure that unit throughput through the hub is maximized over the planning horizon.

DSRO system 160 may be configured to manage resources of hub 140 based on a DSRO to maximize throughput through hub 140 over the planning horizon in accordance with embodiments of the present disclosure. In particular, DSRO system 160 may be configured to provide the main functionality of system 100 to optimize the utilization of hostler resources of hub 140 to pair ramping operations of the IG flow to deramping operations of the IB flow to generate the optimized operating schedule over a planning horizon to maximize the unit throughput of hub 140 over the planning horizon. In embodiments, DSRO system 160 may optimize the utilization of hostler resources of hub 140 over the planning horizon of the optimized operating schedule by leveraging the functionality of a hostler operations optimization system (e.g., hostler operations optimization system 127 of FIG. 2) that may include functionality to identify ramping operations of the IG flow and deramping operations of the IB flow over the planning horizon to pair together to maximize the unit throughput of the hub over the planning horizon.

Figure 2:
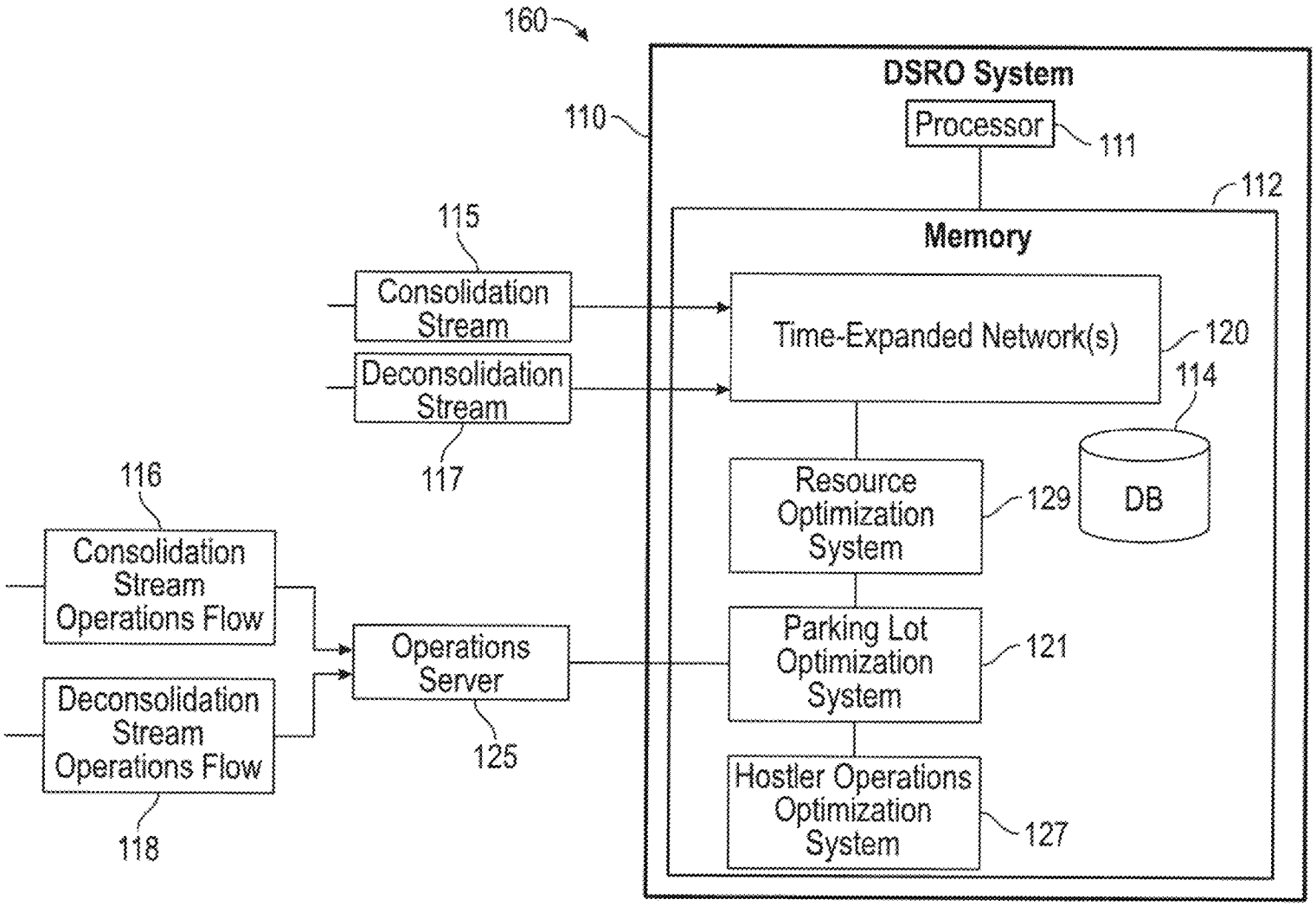
FIG. 2 is a block diagram illustrating an example of DSRO system configured with capabilities and functionality for optimizing the utilization of hostler resources of a hub based on a DSRO in accordance with embodiments of the present disclosure.

FIG. 2 is a block diagram illustrating an example of DSRO system 160 configured with capabilities and functionality for optimizing the utilization of hostler resources of a hub based on a DSRO in accordance with embodiments of the present disclosure. As shown in FIG. 2, DSRO system 160 may be implemented in a server (e.g., server 110). In embodiments, functionality of server 110 to facilitate operations of DSRO system 160 may be provided by the cooperative operation of the various components of server 110, as will be described in more detail below.

It is noted that although FIG. 2 shows server 110 as a single server, it will be appreciated that server 110 (and the individual functional blocks of server 110) may be implemented as separate devices and/or may be distributed over multiple devices having their own processing resources, whose aggregate functionality may be configured to perform operations in accordance with the present disclosure. Furthermore, those of skill in the art would recognize that although FIG. 2 illustrates components of server 110 as single and separate blocks, each of the various components of server 110 may be a single component (e.g., a single application, server module, etc.), may be functional components of a same component, or the functionality may be distributed over multiple devices/components. In such embodiments, the functionality of each respective component may be aggregated from the functionality of multiple modules residing in a single, or in multiple devices. In addition, particular functionality described for a particular component of server 110 may actually be part of a different component of server 110, and as such, the description of the particular functionality described for the particular component of server 110 is for illustrative purposes and not limiting in any way.

As shown in FIG. 2, server 110 includes processor 111, memory 112, time-expanded network 120, parking lot optimization system 121, hostler operations optimization system 127, resources optimization system 129, and database 114.

Processor 111 may comprise a processor, a microprocessor, a controller, a microcontroller, a plurality of microprocessors, an application-specific integrated circuit (ASIC), an application-specific standard product (ASSP), or any combination thereof, and may be configured to execute instructions to perform operations in accordance with the disclosure herein. In some embodiments, implementations of processor 111 may comprise code segments (e.g., software, firmware, and/or hardware logic) executable in hardware, such as a processor, to perform the tasks and functions described herein. In yet other embodiments, processor 111 may be implemented as a combination of hardware and software. Processor 111 may be communicatively coupled to memory 112.

Memory 112 may comprise one or more semiconductor memory devices, read only memory (ROM) devices, random access memory (RAM) devices, one or more hard disk drives (HDDs), flash memory devices, solid state drives (SSDs), erasable ROM (EROM), compact disk ROM (CD-ROM), optical disks, other devices configured to store data in a persistent or non-persistent state, network memory, cloud memory, local memory, or a combination of different memory devices. Memory 112 may comprise a processor readable medium configured to store one or more instruction sets (e.g., software, firmware, etc.) which, when executed by a processor (e.g., one or more processors of processor 111), perform tasks and functions as described herein.

Memory 112 may also be configured to facilitate storage operations. For example, memory 112 may comprise database 114 for storing various information related to operations of system 100. For example, database 114 may store configuration information related to operations of DSRO system 160. In embodiments, database 114 may store information related to various models used during operations of DSRO system 160, such as a DSRO model, a parking lot optimization model, a parking lot classification model, an ingate prediction model, an inbound prediction model, a unit diffusion model, a hostler route operations model, a multi-hop operations model, etc. Database 114 is illustrated as integrated into memory 112, but in some embodiments, database 114 may be provided as a separate storage module or may be provided as a cloud-based storage module. Additionally, or alternatively, database 114 may be a single database, or may be a distributed database implemented over a plurality of database modules.

As mentioned above, operations of hub 140 may be represented as two distinct flows, an IG flow in which units arriving to hub 140 from customers are consolidated into outbound trains to be transported to their respective destinations, and an IB flow in which inbound trains arriving to hub 140 carrying units are deconsolidated into the units that are stored in parking lots while waiting to be picked up by respective customers. DSRO system 160 may be configured to represent the IG flow as consolidation stream 115 including a plurality of stages. Each stage of consolidation stream 115 may represent different operations or events that may be performed or occur to facilitate the IG flow of hub 140. DSRO system 160 may be configured to represent the IB flow as deconsolidation stream 117 including a plurality of stages. Each stage of deconsolidation stream 117 may represent different operations or events that may be performed or occur to facilitate the IB flow of hub 140.

Each of the consolidation stream 115 and deconsolidation stream 117 may include various stages. For example, consolidation stream 115 may be configured to include a plurality of stages, namely an in-gated (IG) stage, an assignment (AS) stage, a ramping (RM) stage, a release (RL) stage, and a departure (TD) stage. Deconsolidation stream 115 may be configured to include a plurality of stages, namely an arrival (TA) stage, a strip track placement (ST-PU) stage, a de-ramping (DR) stage, a unit park and notification (PN) stage, and an out-gated (OG) stage. In embodiments, each of the stages of each of consolidation stream 115 and deconsolidation stream 117 may represent an event or operations that may be performed or occur to facilitate the flow of a unit through each of the streams.

In particular, the RM stage of consolidation stream 115 may represent ramping operations of the IG flow in which containers may be loaded onto an outbound train for transportation to the destination of the container. In embodiment, during the RM stage, the container may be assigned to a railcar of an outbound train, such as based on the unit's destination and/or the desired delivery time, such as based on a scheduled train lineup. In particular embodiments, the RM stage of consolidation stream 115 may operate to consolidate containers with a same destination (or with a destination that is within a particular route) into a single outbound train based on their destination. During the RM stage of consolidation stream 115, a container may be transported by a hostler (e.g., from a current parking spot) to the production track in which the outbound train is being loaded. The container may then be loaded onto the assigned railcar.

In embodiments, the DR stage of deconsolidation stream 117 may represent deramping operations of the IB flow. During the DR stage, containers arriving to the hub in an inbound train may be unloaded or deramped from the inbound train onto allocated chassis. In embodiments, the unloaded (e.g., or deramped) containers may then be transported by a hostler and parked in a parking spot in a parking lot to wait to be picked up by a customer during the PN and OG stages.

In embodiments, the interaction between consolidation stream 115 and deconsolidation stream 117, with respect to the use of resources of hub 140, may be collaborative or competing. For example, the utilization hostler resources in the ramping and deramping operations within hub 140 between consolidation stream 115 and deconsolidation stream 117, may be collaborative. In this manner, hostler operations (e.g., hostler operations in which a hostler is assigned to follow a route to pick up a unit from a parking spot and ramp the unit onto an outbound train and/or to deramp a unit from an incoming train and transport it to an assigned parking spot) may be based on the optimized operating schedule.

In embodiments, DSRO system 160 may be configured to optimize the use of resources to maximize the throughput of the hub (e.g., the rate of units processed through the hub) by generating one or more time-expanded networks 120 to represent consolidation stream 115 and deconsolidation stream 117, and configuring the DSRO model to use one or more time-expanded networks 120, over a planning horizon, to optimize the use of the resources of the hub that support the unit flow within the planning horizon to maximize the throughput of units over the planning horizon. In embodiments, the DSRO model may generate, based on the one or more time-expanded networks 120, an optimized operating schedule that includes one or more of a determined unit flow through one or more of the stages of time-expanded network (e.g., the consolidation and/or deconsolidation stream time-expanded networks) at each time increment of the planning horizon, an indication of a resource deficit or overage at one or more of the stages of each time-expanded network at each time increment of the planning horizon, and/or an indication or recommendation of a resource replenishment to be performed at one or more of the stages of each time-expanded network at each time increment of the planning horizon to ensure the optimized operating schedule is met.

Particular to the present disclosure, the optimized operating schedule may include recommendations for ramping and/or deramping operations at each time increment of the planning horizon of the optimized operating schedule configured to maximize the unit throughput within the hub during execution of the optimized operating schedule. The ramping and/or deramping operation recommendations may include recommendations on how to perform ramping operations (e.g., how hostler may ramp units from a current parking spot to an assigned outbound train) and/or deramping operations (e.g., how hostler may deramp units from an inbound train and transport them to an assigned parking spot) at each time increment of the planning horizon. In this manner, during execution of the optimized operating schedule, operators may perform ramping operations and/or deramping operations according to the recommendations in the optimized operating schedule to ensure that the unit throughput of the hub over the planning horizon of the optimized operating schedule is maximized.

In embodiments, DSRO system 160 may be configured to apply the DSRO model to the time-expanded networks 120 to optimize the use of the resources (e.g., parking lot resources) by the consolidation and deconsolidation streams over the planning horizon to maximize the unit throughput of the hub over the planning horizon to generate the optimized operating schedule. To that end, DSRO 160 may include a plurality of optimization systems. For example, resource optimization system 129 may be configured to generate, based on the DSRO model, an optimized operating schedule that may be implemented over a planning horizon to maximize throughput of units through the hub. In particular, resource optimization manager 129 may be configured to consider resource availability (e.g., resource inventory), resource replenishment cycles, resource cost, operational implications of inadequate supply of resources, for all the resources involved in the consolidation and deconsolidation streams to determine the optimized operating schedule that may maximize throughput through the hub over the planning horizon. Resource optimization manager 129 may be configured to additionally consider unit volumes (e.g., unit volumes expected to flow during the planning horizon through the consolidation stream and the deconsolidation streams, such as at each time increment of the planning horizon) and unit dwell times (e.g., expected dwell times of units flowing through the consolidation stream and the deconsolidation streams during the planning horizon) to determine the optimized operating schedule that may maximize throughput through the hub over the planning horizon.

During operations (e.g., during execution of the operating schedule, when units arrive at the hub), operations server 125 may operate to manage execution of the optimized operational schedule by monitoring consolidation stream operations flow 116 (e.g., the actual traffic flow through the consolidation stream 115 during execution of the optimized operating schedule) and deconsolidation stream operations flow 118 (e.g., the actual traffic flow through the deconsolidation stream 117 during execution of the optimized operating schedule) to ensure that the optimized operational schedule is being executed properly, and to update the optimized operating schedule based on the actual unit traffic, which may impact resource availability and/or consumption, especially when the actual unit traffic during execution of the optimized operational schedule differs from the predicted unit traffic used in the generation of the optimized operational schedule.

In embodiments, the functionality of DSRO system 160 to optimize the utilization of hostler resources to generate the optimized operating schedule may include leveraging the functionality of hostler operations optimization system 127. Hostler operations optimization system 127 may be configured to optimize hostler operations by intelligently pairing ramp and deramp operations based on pairing criteria. The pairing of the ramp and deramp operations based on pairing criteria may be configured to maximize the unit throughput of the hub over the planning horizon of the optimized operating schedule. The paired ramp and deramp operations may be included in the optimized operating schedule. In this manner, during execution of the optimized operating schedule, operators may perform the paired ramp and deramp operations in accordance with the recommendations in the optimized operating schedule, which may lead to maximized unit throughput over the planning horizon.

Figure 3:
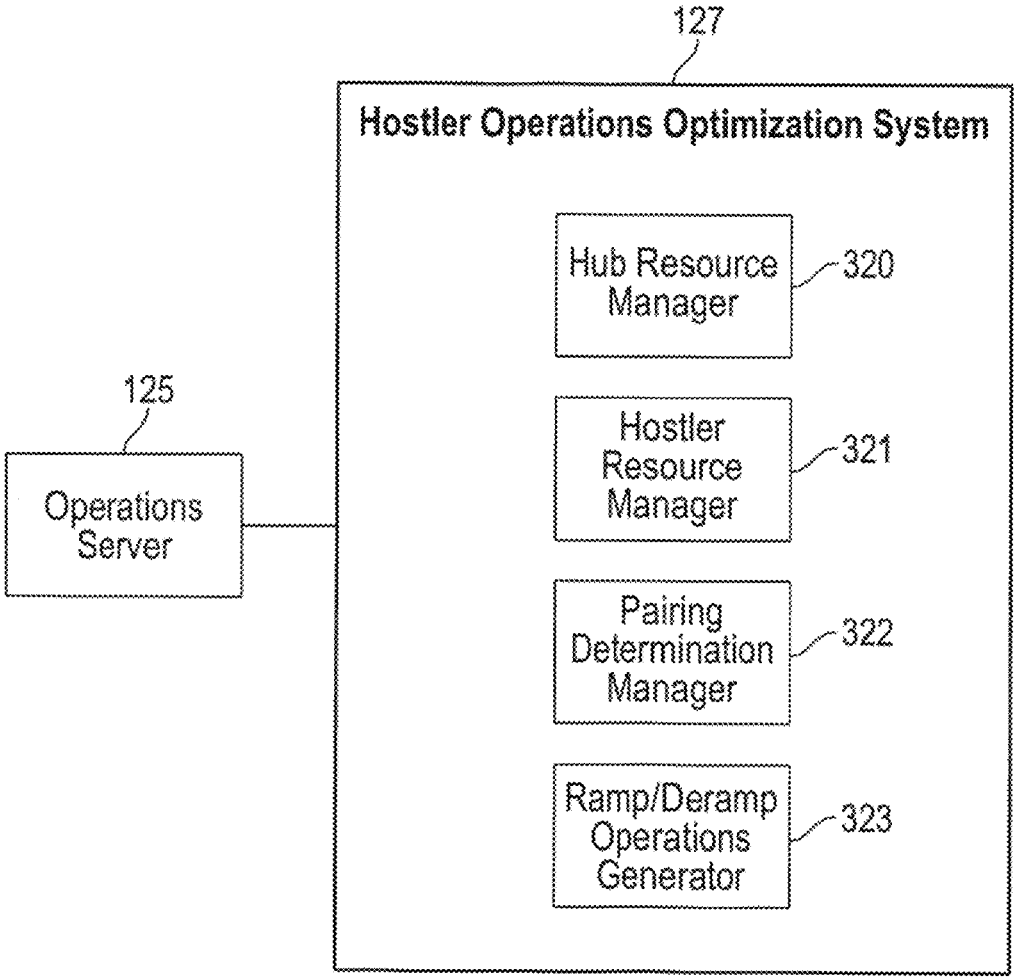
FIG. 3 is a block diagram of an exemplary hostler operations optimization system configured with functionality for optimizing utilization of hostler resources of a hub in accordance with embodiments of the present disclosure.

Operations of hostler operations optimization system 127 will now be discussed with respect to FIG. 3. FIG. 3 is a block diagram of an exemplary hostler operations optimization system 127 configured with functionality for optimizing utilization of hostler resources of a hub in accordance with embodiments of the present disclosure. As shown in FIG. 3, hostler operations optimization system 127 may include hub resource manager 320, hostler resource manager 321, pairing determination manager 322, and ramp/deramp operations generator 323.

Resource manager 320 may be configured to obtain the current inventory levels of all resources that are part of the operations of the hub. In some embodiments, the functionality of resource manager 320 to obtain the current inventory levels of all resources that are part of the operations of the hub may be part of the functionality of DSRO system 160 to generate the optimized operating schedule. In embodiments, the functionality of resource manager 320 to obtain the current inventory levels may include functionality to fetch and update the current inventory levels of all resources that are part of the operations of the hub from operations server 125.

In embodiments, these resources may include hostlers, which may include vehicles and drivers used for moving trailers within the hub. Lift capacity, which may include the maximum weight that the lifting equipment at the hub can handle, may also monitored by resource manager 320. In addition, resource manager 320 may keep track of the availability of parking spots within the hub. These parking spots may be used for temporarily storing the units or containers that are brought into the hub. The ingate capacity limits, which may include the maximum number of units that may be processed through the ingate stream of the hub, are also under the purview of resource manager 320.

In embodiments, resource manager 320 may be configured to manage the inventory of railcars and locomotives. Railcars may include the individual units that make up a train and may be used for transporting the containers, and locomotives may include the engines that power these trains.

The availability and operational status of these resources may be constantly monitored and updated by resource manager 320.

In embodiments, resource manager 320 may also be configured to fetch details related to train schedules and consist details from the operations server 125. The train schedules provide information about the arrival and departure times of trains at the hub, while the consist details provide information about the composition of each train, including the number and types of railcars and the load they are carrying. This information may be pivotal in planning and optimizing the operations of the hub.

Hostler resource manager 321 may be configured to Assess current and capacity levels of the hostler resources over the planning horizon in order to optimize the utilization of the hostler resources by generating hostler operation recommendations (e.g., hostler ramp operations and hostler deramp operations recommendations) for each time increment of the planning horizon that result in an optimized unit throughput of the hub over the planning horizon. The resulting hostler operation recommendations may be included in the optimized operating schedule to be recommended during execution of the optimized operating schedule, at each time increment of the planning horizon. For example, during execution of the optimized operating schedule, the functionality of operations server 125, which may store the optimized operating schedule, may be leveraged to generate hostler operations in accordance with the optimized operating schedule by following the hostler operation recommendations. A hostler assigned a hostler operations in accordance with a hostler operation recommendation may perform the hostler operation accordingly.

Hostler resource manager 321 may be configured to assess the current and capacity levels of the hostler resources over the planning horizon. This assessment is integral to the optimization of the utilization of the hostler resources. Hostler resource manager 321 generates hostler operation recommendations, which include hostler ramp operations and hostler deramp operations recommendations, for each time increment of the planning horizon. These hostler operation recommendations may be configured to result in an optimized unit throughput of the hub over the planning horizon.

In embodiments, the hostler operation recommendations generated by hostler resource manager 321 may be included in the optimized operating schedule. This optimized operating schedule may be recommended during the execution of the optimized operating schedule, at each time increment of the planning horizon. For example, during the execution of the optimized operating schedule, the functionality of operations server 125, which may store the optimized operating schedule, may be leveraged to generate hostler operations. These hostler operations may be generated in accordance with the optimized operating schedule by following the hostler operation recommendations. For example, a hostler who may be assigned a hostler operation in accordance with a hostler operation recommendation for a time increment, may be expected to perform the hostler operation accordingly. This ensures that the hostler operations are carried out efficiently and effectively, in accordance with the optimized operating schedule over the planning horizon, contributing to the overall optimization of the hub operations.

In embodiments, a hostler ramp operation may include operations in which a hostler may be assigned to follow a route to pick up a unit from a parking spot and transport the unit to production tracks to ramp the unit onto an outbound train. A hostler deramp operation may include operations in which a hostler may be assigned to follow a route to the production tracks to deramp a unit from an inbound train and transport the unit to a parking spot assigned to the unit. These hostler operations may be based on recommendations in the optimized operating schedule, defining how units parked in parking spaces in the hub may be moved or transported to load them or ramp them onto outbound trains and/or how units arriving in inbound trains may be deramped or unloaded from the inbound trains and moved or transported to their assigned parking spots. These particular recommendations related to hostler operations in the optimized operating schedule may be configured to optimize the use of the hostler resources over the planning horizon. Pairing determination manager 322 may be configured to pair these operations to further optimize the operating schedule by optimizing the utilization of the hostlers during execution of the ramp and deramp operations.

Pairing determination manager 322, may be configured to identify ramp and deramp operations in each time increment of the planning horizon that may be paired based on the current and capacity levels of the hostler resources over the planning horizon. Identifying ramp and deramp operations that may be paired to increase unit throughput over the planning horizon includes identifying hostler operations that may meet particular criteria.

For example, the pairing determination manager 322 may be configured to identify hostler operations where one operation, let's call it the first operation, has a hostler route that concludes at an end-point that is within a predetermined threshold distance of the start-point of the hostler route of another operation, which we'll refer to as the second operation. This strategic pairing leverages the proximity of the hostler at the end-point of the first operation to the start-point of the second operation.

In practical terms, this means that the hostler, after completing the first operation and dropping off the unit at the designated end-point, can pick up the unit involved in the second operation with minimum delay, as the hostler does not have to travel a long distance to reach the location of the unit in the second operation. This efficient use of the hostler to perform the paired hostler operations results in a minimized impact on the hostler resources. The outcome of this strategic pairing is an improved or maximized unit throughput over the planning horizon. This means that more units can be processed within the planning horizon during execution of the optimized operating schedule, increasing the overall efficiency and productivity of the hub operations. This innovative approach to resource management not just enhances the operational efficiency of the hub but also contributes to cost savings by optimizing the use of available resources.

The process of identifying ramp and deramp operations that may be paired to maximize unit throughput over the planning horizon may involve a strategic evaluation of the hostler routes of the corresponding hostler operations. This includes identifying deramp operations that have a route which brings the hostler within a specified threshold distance of a unit that requires ramping onto an outbound train. This process may be performed for each time increment of the planning horizon, such that deramp and ramp operations that may meet the criteria for pairing may be identified for each time increment.

For example, a deramp operation may be identified for a specific time increment that involves deramping a unit and subsequently dropping it off at an assigned parking spot, which is considered the end-point of the deramp operation. Pairing determination manager 322 may identify and processes the ramp operations in the same time increment. These ramp operations include a start-point, which is the parking spot from where the unit being ramped is currently parked. Pairing determination manager 322 may be configured to identify ramp operations where the start-point is within a threshold distance of the end-point of the deramp operation. From the identified ramp operations, pairing determination manager 322 may select one and may pair it with the deramp operation. This pairing ensures that, during execution of the optimized operating schedule, the selected ramp operation is performed immediately after the deramp operation during the specific time increment.

This strategic pairing leverages the proximity of the hostler at the end-point of the deramp operation to the start-point of the selected ramp operation. In practical terms, this means that the hostler, after completing the deramp operation and dropping off the unit at the designated end-point, can pick up the unit involved in the ramp operation with minimum delay, as the hostler does not have to travel a long distance to reach the location of the unit in the ramp operation.

In another example, the process of identifying ramp and deramp operations that may be paired to maximize unit throughput over the planning horizon may include identifying ramp operations that involve ramping a unit onto a railcar of an outbound train that is within a specified threshold distance of a unit that requires deramping from an inbound train. This process may be performed for each time increment of the planning horizon, such that deramp and ramp operations that may meet the criteria for pairing may be identified for each time increment.

For example, a ramp operation may be identified for a specific time increment that involves picking up a unit from a current parking spot and subsequently ramping it or loading it onto an outgoing train, which is considered the end-point of the ramp operation. Pairing determination manager 322 may identify and processes the deramp operations in the same time increment. These deramp operations include a start-point, which is the location of the railcar from where the unit being deramped is currently located. Pairing determination manager 322 may be configured to identify deramp operations where the start-point is within a threshold distance of the end-point of the ramp operation. From the identified deramp operations, pairing determination manager 322 may select one and may pair it with the ramp operation. This pairing ensures that, during execution of the optimized operating schedule, the selected deramp operation is performed immediately after the ramp operation during the specific time increment.

This strategic pairing leverages the proximity of the hostler at the end-point of the ramp operation to the start-point of the selected deramp operation. In practical terms, this means that the hostler, after completing the ramp operation and loading the unit onto the assigned railcar (e.g., the designated end-point), can pick up the unit involved in the deramp operation with minimum delay, as the hostler does not have to travel a long distance to reach the location of the unit in the deramp operation.

In situations, pairing determination manager 322 may be unable to identify any pairs of ramp and de-ramp operations within a specific time increment that meet the established criteria. In these cases, an alternative approach may be employed. This involves the generation of staggered ramping and deramping operations for all time increments.

Staggered ramping and deramping operations may include the process of scheduling ramp and deramp operations in a non-overlapping or offset manner. This means that the start of one operation does not coincide with the end of another, ensuring that there is no conflict or overlap in the utilization of hostler resources. The generated staggered ramping and deramping moves may be transmitted to operations server 125. Operations server 125 may be configured to manage and coordinate the execution of the optimized operating schedule over the planning horizon. Operations server 125 may receive the staggered ramping and deramping moves and integrates them into the overall operational plan for the hub.

This approach ensures that even in scenarios where pairing may not be possible or may not lead to optimization by hostler operations pairing, the system can still optimize the utilization of hostler resources by strategically scheduling ramp and deramp operations. This contributes to the overall efficiency of the hub operations and helps in maximizing the unit throughput of the hub over the planning horizon.

Ramp/deramp operations generator 323 may be configured to generate paired hostler operations for one or more time increments of the planning horizon to be included in the optimized operating schedule. In embodiments, the paired hostler operations are included in the optimized operating schedule and transmitted to the operations server 125 for storage and subsequent execution. In this manner, the paired hostler operations for the one or more time increments of the planning horizon may represent optimization of the utilization of the hostler resources.

The generation of the paired hostler operations for a specific time increment may involve the creation of a control signal. This control signal may be configured to define an execution sequence of the paired hostler operations. For example, the control signal may be configured to trigger one of the hostler operations to be performed immediately after the completion of the other operation. This sequential execution of operations is a strategic approach to optimize the utilization of hostler resources and increase the overall efficiency of the hub operations.

Each of the paired hostler operations includes a start point, which is the point at which the hostler operation commences, and an end point, which is the point at which the hostler operation concludes. For example, a ramp operation may start at the point where the hostler initiates movement towards the unit that is to be ramped. Alternatively, the start point may be the parking spot where the unit to be ramped is currently parked. The end point of a ramp operation may include the point at which the unit is ramped onto an outbound train, specifically, the location of the railcar onto which the unit is ramped.

Similarly, a deramp operation may start at the point where the hostler initiates movement towards the unit that is to be deramped or it may start at the location of the railcar in which the unit to be deramped is currently placed. The end point of a deramp operation is the point at which the deramped unit is parked, specifically, the parking spot to which the deramped unit is assigned.

In the case of a hostler performing a ramp/deramp pair or a deramp/ramp pair, the hostler completes the first operation, reaching the end point of the first operation. Immediately after this (e.g., without a detour to another location), the hostler may drive from the end point of the first operation to the start point of the second operation to perform the second operation in the pair. This strategic pairing and sequencing of operations ensure efficient utilization of hostler resources and contribute to the overall productivity of the hub operations.

Figure 4:
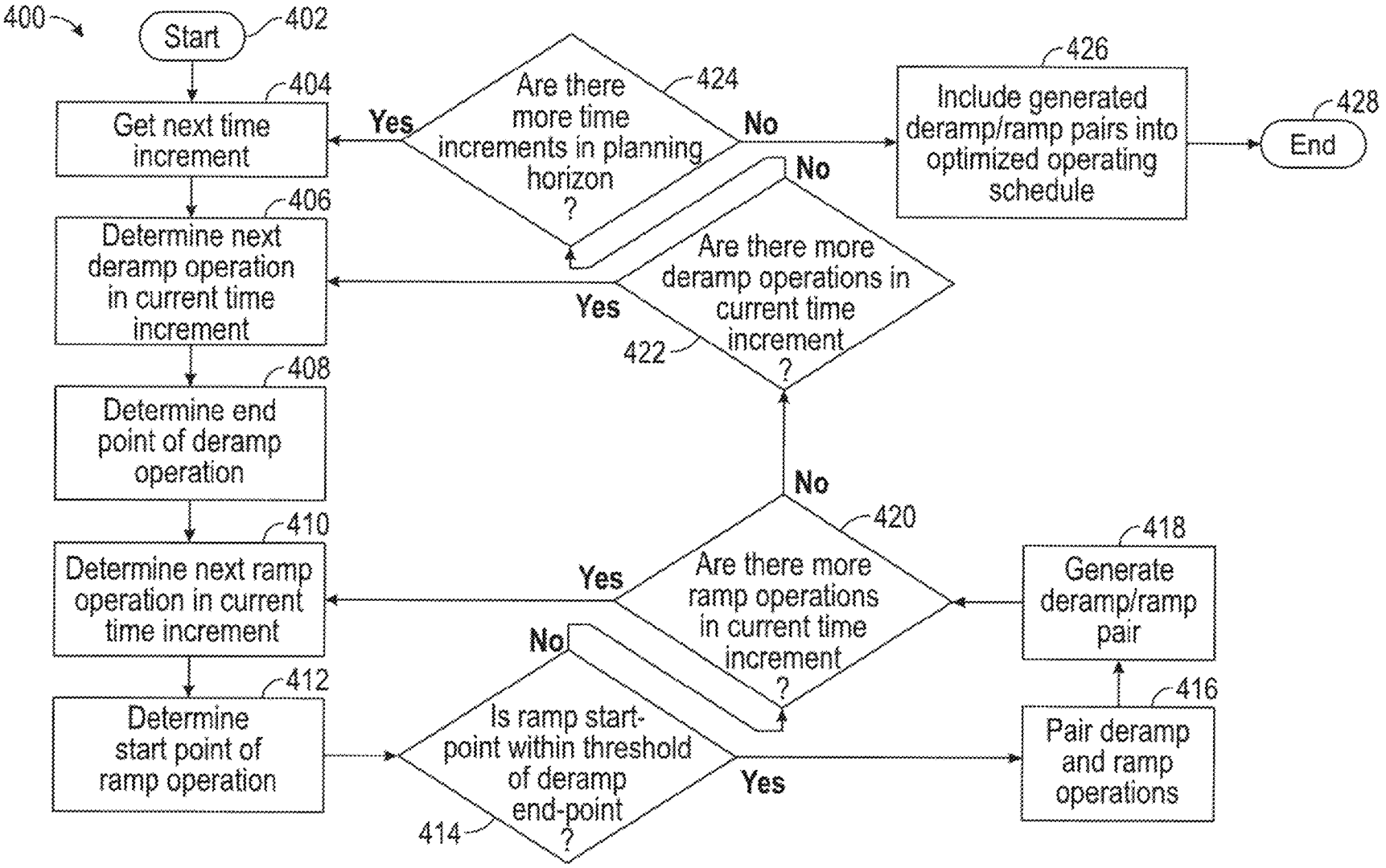
FIG. 4 is a flowchart illustrating operations of a hostler operations optimization system configured with functionality for optimizing utilization of hostler resources of a hub in accordance with embodiments of the present disclosure.
Figure 5:
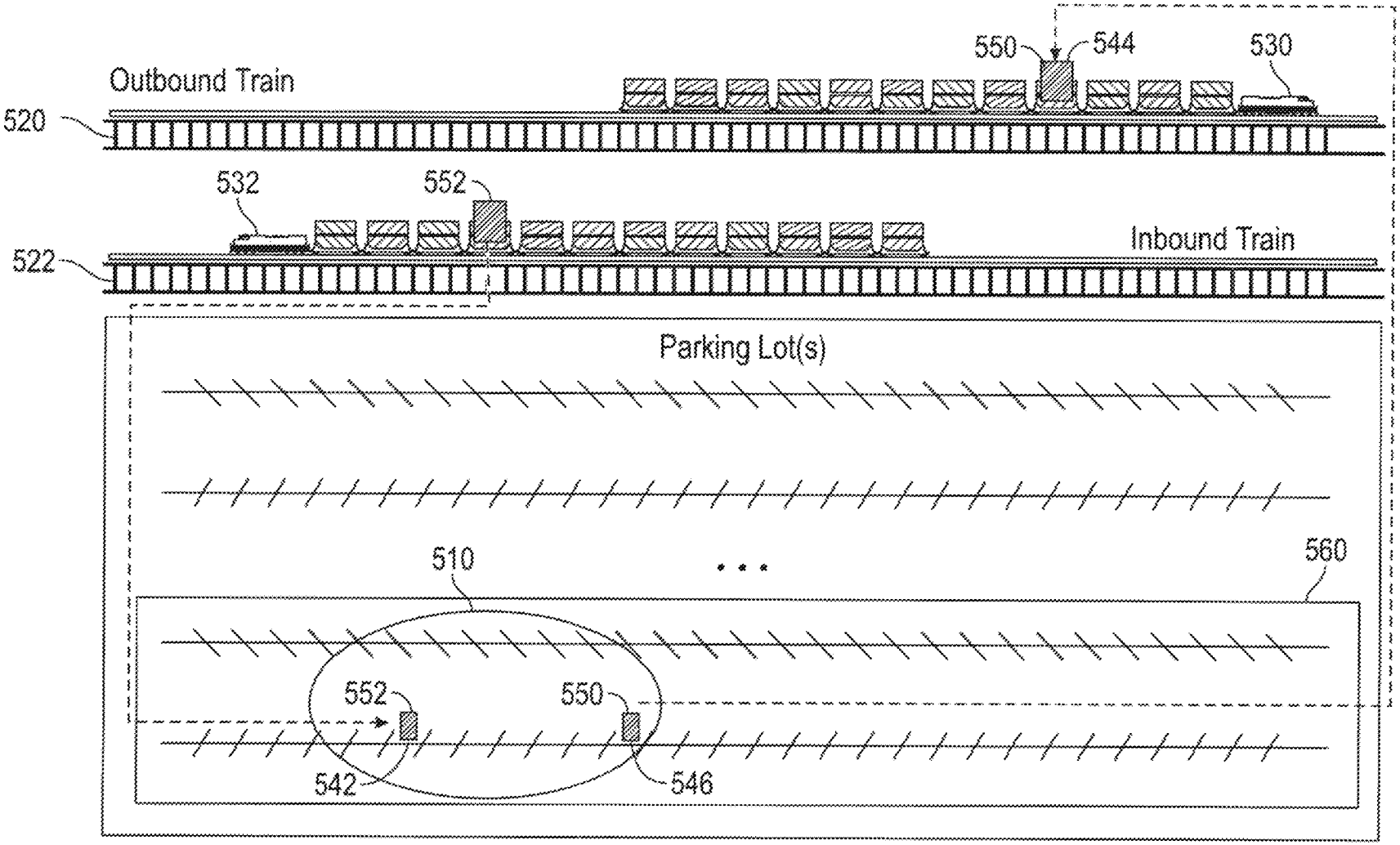
FIG. 5 illustrates operations to optimize utilization of hostler resources to generate an optimized operating schedule associated with a hub in accordance with embodiments of the present disclosure.

FIG. 4 is a flowchart illustrating operations of a hostler operations optimization system 127 configured with functionality for optimizing utilization of hostler resources of a hub in accordance with embodiments of the present disclosure. The operations illustrated in FIG. 4 will be discussed with further reference to FIG. 5. FIG. 5 illustrates operations to optimize utilization of hostler resources to generate an optimized operating schedule associated with a hub in accordance with embodiments of the present disclosure. In particular, the operations illustrated in FIGS. 4 and 5 include operations of hostler operations optimization system 127 to identify and pair deramp operations to ramp operations in time increments of the planning horizon of the optimized operating schedule to generate deramp/ramp pairs in which a ramp operation of a hostler may be leveraged to perform a ramp operation while minimizing the impact to the hostler resources of the hub.

The optimization process begins at block 402, where the system initiates the sequence of operations designed to optimize the utilization of hostler resources within the hub. This is the starting point of the optimization process, setting the stage for the subsequent steps. At block 404, the hostler operations optimization system identifies the first time increment of the planning horizon. The planning horizon is the period during which the optimization of hostler operations is to be executed. It is divided into multiple time increments, each representing a discrete time period. Specific hostler operations that are to be recommended for each time increment are analyzed and optimized.

At block 406, the hostler operations optimization system may determine a deramp operation that is recommended for execution during the current time increment. This recommendation is typically generated as part of the initial optimization of resources by the DSRO system 160. The DSRO system takes into account various factors such as resource availability, unit throughput, and operational constraints to generate this recommendation. This step is integral in identifying the operations that are to be optimized. For example, as shown in FIG. 5, unit 552 may be expected to arrive in inbound train 532 on production track 522, and may be expected to be assigned to a parking lot (e.g., a parking lot 560). In some embodiments, unit 552 may be expected to be assigned to parking spot 542. DSRO system 160 and/or the hostler operations optimization system may determine a deramp operation configured to deramp unit 552 from inbound train 532 and transport it to the assigned parking lot 560 and/or assigned parking stop 542.

At block 408, the hostler operations optimization system may identify the end-point of the deramp operation determined in block 406. The end-point is the location within the hub where the deramped unit is to be parked, which is typically an assigned parking spot. This step is pivotal in determining the final destination of the deramped unit within the hub. For example, the hostler operations optimization system may identify parking lot 560 and/or assigned parking stop 542 as the end-point of the deramp operation for unit 552.

At block 410, the hostler operations optimization system may determine a ramp operation that is recommended for the current time increment. This ramp operation may be one of potentially several operations recommended for execution during the same time increment. This step is integral in identifying the operations that are to be optimized. For example, as shown in FIG. 5, unit 550 currently parked in parking spot 546 of parking lot 560 may be expected or known to be assigned to outbound train 530 and/or to railcar 544 of outbound train 530. DSRO system 160 and/or the hostler operations optimization system may determine a ramp operation configured to transport unit 550 from parking spot 546 and/or parking lot 560 to outbound train 530.

At block 412, the hostler operations optimization system may determine the start point of the ramp operation determined at block 410. The start point is typically the parking spot where the unit to be ramped is currently located. This step is pivotal in determining the initial location of the unit that is to be ramped. For example, the hostler operations optimization system may identify parking lot 560 and/or parking stop 546 as the start-point of the ramp operation for unit 550.

At block 414, the hostler operations optimization system may determine whether the start-point of the ramp operation is within a threshold distance of the end-point of the deramp operation. In response determining that the start-point of the ramp operation is within the threshold distance of the end-point of the deramp operation, indicating that the hostler can efficiently transition from the deramp operation to the ramp operation, the hostler operations optimization system may, at block 416, pair the deramp operation to the ramp operation and may generate, at block 418, a deramp/ramp pair. This pairing may be configured to minimize the travel time and distance for the hostler, optimizing resource utilization and increasing unit throughput. This step is pivotal in creating an efficient sequence of operations that maximizes the utilization of hostler resources.

For example, DSRO system 160 and/or the hostler operations optimization system my determine whether the parking lot to which unit 552 is assigned and the parking lot in which unit 550 is currently parked are the same. In response to a determination that the parking lot to which unit 552 is assigned and the parking lot in which unit 550 is currently parked are the same, DSRO system 160 and/or the hostler operations optimization system my determine that the start-point of the ramp operation is within the threshold distance of the end-point of the deramp operation. However, in response to a determination that the parking lot to which unit 552 is assigned and the parking lot in which unit 550 is currently parked are not the same, DSRO system 160 and/or the hostler operations optimization system my determine that the start-point of the ramp operation is not within the threshold distance of the end-point of the deramp operation.

In another example, DSRO system 160 and/or the hostler operations optimization system my determine whether parking spot 542 to which unit 552 is assigned and parking spot 546 in which unit 550 is currently parked are within a threshold distance 510 of each other. In response to a determination that parking spot 542 to which unit 552 is assigned and parking spot 546 in which unit 550 is currently parked are within threshold distance 510 of each other, DSRO system 160 and/or the hostler operations optimization system my determine that the start-point of the ramp operation is within the threshold distance of the end-point of the deramp operation. However, in response to a determination that parking spot 542 to which unit 552 is assigned and parking spot 546 in which unit 550 is currently parked are not within threshold distance 510 of each other, DSRO system 160 and/or the hostler operations optimization system my determine that the start-point of the ramp operation is not within the threshold distance of the end-point of the deramp operation.

In embodiments, the hostler operations optimization system may, before pairing the deramp operation to the ramp operation at block 416, determine whether the pairing this deramp operations to this ramp operation yields a higher unit throughput over the planning horizon than the unit throughput obtain by pairing this deramp operations to another ramp operation in the same time increment. In these embodiments, the pairing may be performed after all potential candidate pairs have been determined for the current time increment.

In response to determining that the start-point of the ramp operation is not within the threshold distance of the end-point of the deramp operation, the hostler operations optimization system may, at block 420, determine whether there are other ramp operations in the current time increment that have not been analyzed to determine whether these ramp operations meet the threshold distance criteria with respect to the current deramp operation. In response to a determination, at block 420, that there are other ramp operations in the current time increment that have not been analyzed with respect to the current deramp operation, the hostler operations optimization system may, at block 410, obtain a next ramp operation and may continue the analysis as described with respect to block 412. This step ensures that all potential ramp operations are considered for pairing with the deramp operation.

However, in response to a determination, at block 420, that there are no other ramp operations in the current time increment that have not been analyzed with respect to the current deramp operation, the hostler operations optimization system may, at block 422, determine whether there are other deramp operations in the current time increment that have not been analyzed. In response to a determination, at block 422, that there are other deramp operations in the current time increment that have not been analyzed, the hostler operations optimization system may, at block 406, obtain a next deramp operation and may continue the analysis as described with respect to block 408. This step ensures that all potential deramp operations are considered for pairing with the ramp operation.

However, in response to a determination, at block 422, that there are no other deramp operations in the current time increment that have not been analyzed, the hostler operations optimization system may, at block 424, determine whether there are other time increments in the planning horizon of the optimized operating schedule being generated. In response to a determination, at block 424, that there are other time increments in the planning horizon of the optimized operating schedule being generated, the hostler operations optimization system may, at block 404, obtain a next time increment and may continue the analysis as described with respect to block 406. This step ensures that the optimization process is carried out for the complete planning horizon.

However, in response to a determination, at block 424, that there are no other time increments in the planning horizon of the optimized operating schedule being generated, the hostler operations optimization system may, at block 426, include the generated deramp/ramp pairs for each time increment in the planning horizon into the optimized operating schedule. The optimized operating schedule may be sent to operations server 125 for storage and subsequent execution. This final step is pivotal in creating an optimized operating schedule that maximizes the utilization of hostler resources and increases the unit throughput of the hub. Operations end at block 428.

Figure 6:
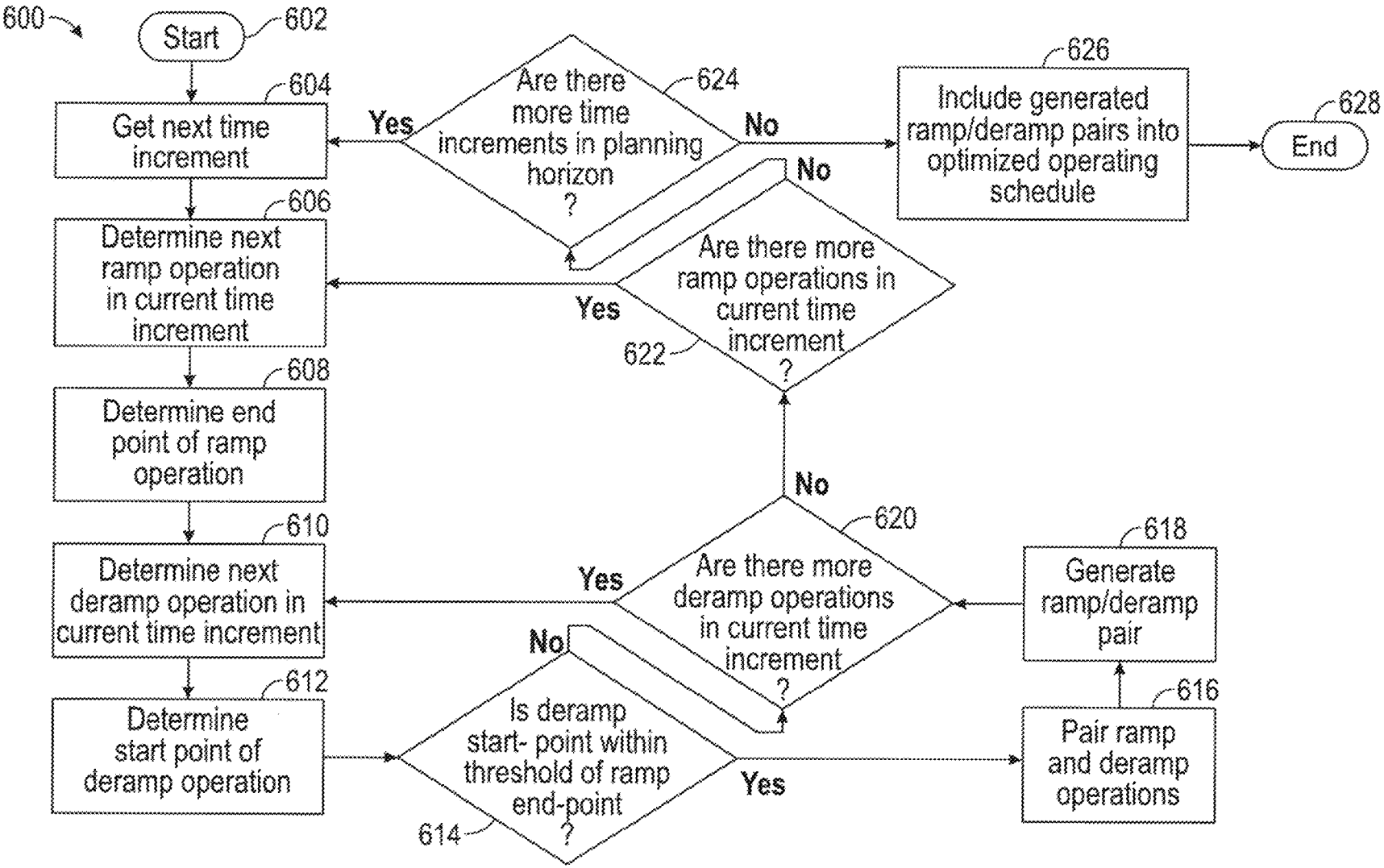
FIG. 6 is a flowchart illustrating operations of a hostler operations optimization system configured with functionality for optimizing utilization of hostler resources of a hub in accordance with embodiments of the present disclosure.
Figure 7:
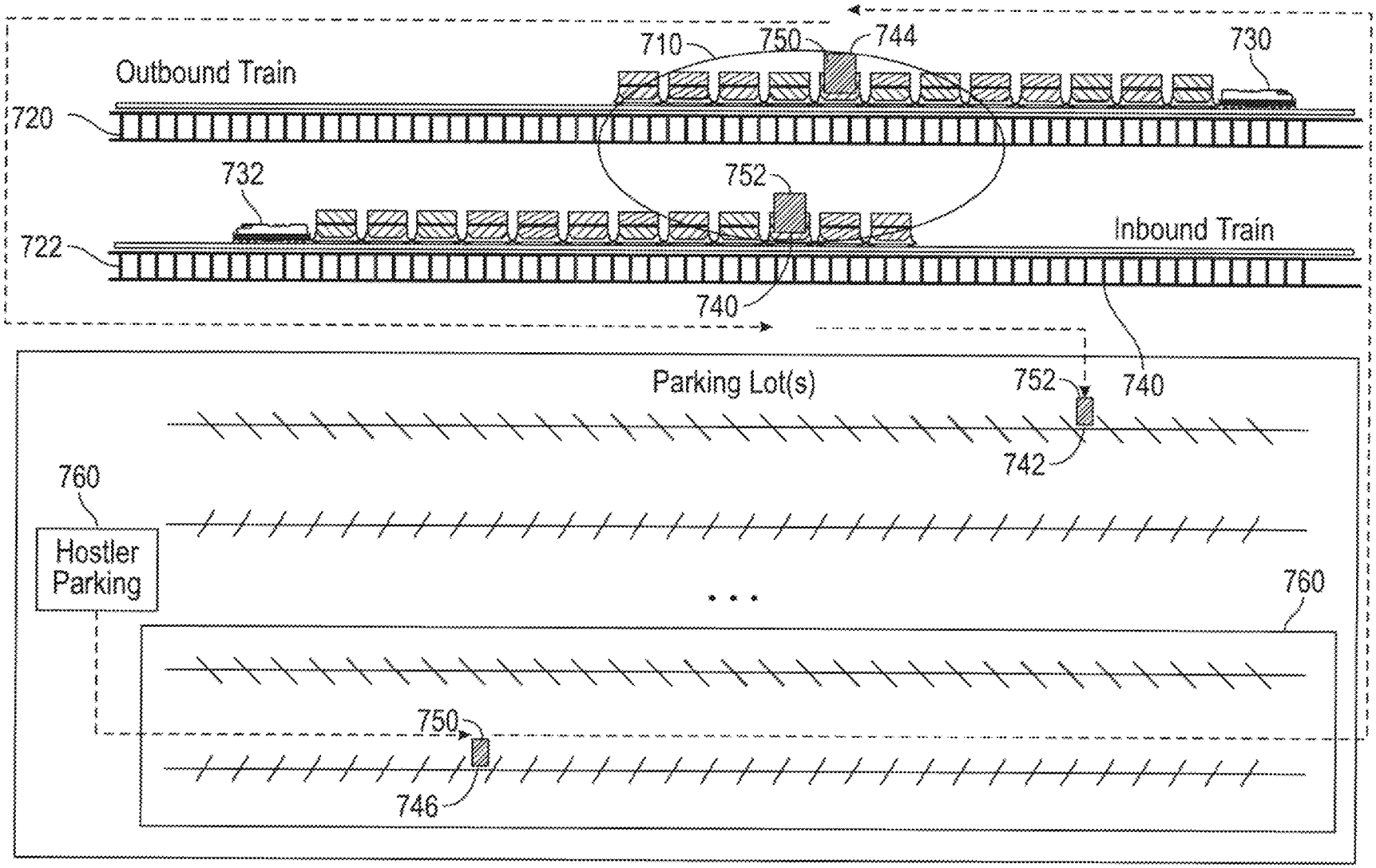
FIG. 7 illustrates operations to optimize utilization of hostler resources to generate an optimized operating schedule associated with a hub in accordance with embodiments of the present disclosure.

FIG. 6 is a flowchart illustrating operations of a hostler operations optimization system 127 configured with functionality for optimizing utilization of hostler resources of a hub in accordance with embodiments of the present disclosure. The operations illustrated in FIG. 6 will be discussed with further reference to FIG. 7. FIG. 7 illustrates operations to optimize utilization of hostler resources to generate an optimized operating schedule associated with a hub in accordance with embodiments of the present disclosure. In particular, the operations illustrated in FIGS. 6 and 7 include operations of hostler operations optimization system 127 to identify and pair ramp operations to deramp operations in time increments of the planning horizon of the optimized operating schedule to generate ramp/deramp pairs in which a ramp operation of a hostler may be leveraged to perform a deramp operation while minimizing the impact to the hostler resources of the hub.

The optimization process begins at block 602, where the system initiates the sequence of operations designed to optimize the utilization of hostler resources within the hub. This is the starting point of the optimization process, setting the stage for the subsequent steps. At block 604, the hostler operations optimization system identifies the first time increment of the planning horizon.

At block 606, the hostler operations optimization system may determine a ramp operation that is recommended for execution during the current time increment. This recommendation is typically generated as part of the initial optimization of resources by the DSRO system 160. The DSRO system takes into account various factors such as resource availability, unit throughput, and operational constraints to generate this recommendation. This step is integral in identifying the operations that are to be optimized. For example, as shown in FIG. 7, unit 750 currently parked at parking spot 746 of parking lot 760 may be expected to be assigned to outbound train 730 on production track 720, and/or may be expected to be assigned to railcar 744. DSRO system 160 and/or the hostler operations optimization system may determine a ramp operation configured to transport unit 750 from parking spot 746 and/or parking lot 760 to outbound train 730.

At block 608, the hostler operations optimization system may identify the end-point of the ramp operation determined in block 406. The end-point may be the location within the hub where the ramped unit is to be loaded to, which is typically an assigned railcar of an outbound train. This step is pivotal in determining the final destination of the deramped unit within the hub. For example, the hostler operations optimization system may identify railcar 744 of outbound train 730 as the end-point of the ramp operation for unit 750.

At block 610, the hostler operations optimization system may determine a deramp operation that is recommended for the current time increment. This deramp operation may be one of potentially several operations recommended for execution during the same time increment. This step is integral in identifying the operations that are to be optimized. For example, as shown in FIG. 7, unit 752 may be expected to arrive at the hub in railcar 740 of inbound train 730 on production track 722, to a parking lot and/or a parking spot (e.g., parking spot 742. DSRO system 160 and/or the hostler operations optimization system may determine a deramp operation configured to unload unit 752 from inbound train 732 and transport it to it assigned location.

At block 612, the hostler operations optimization system may determine the start point of the deramp operation determined at block 610. The start point is typically the railcar from which the unit is to be deramped. This step is pivotal in determining the initial location of the unit that is to be ramped. For example, the hostler operations optimization system may identify railcar 740 of inbound train 730 on production track 722 as the start-point of the deramp operation.

At block 614, the hostler operations optimization system may determine whether the start-point of the deramp operation is within a threshold distance of the end-point of the ramp operation. In response determining that the start-point of the deramp operation is within the threshold distance of the end-point of the ramp operation, indicating that the hostler can efficiently transition from the ramp operation to the deramp operation, the hostler operations optimization system may, at block 616, pair the ramp operation to the deramp operation and may generate, at block 618, a ramp/deramp pair. This pairing may be configured to minimize the travel time and distance for the hostler, optimizing resource utilization and increasing unit throughput. This step is pivotal in creating an efficient sequence of operations that maximizes the utilization of hostler resources.

For example, DSRO system 160 and/or the hostler operations optimization system my determine whether the railcar to which unit 750 is to be ramped (e.g., railcar 744 of outbound train 730) is within threshold distance 710 of the railcar from which unit 752 is to be deramped (e.g., railcar 740 of inbound train 722). In response to a determination that railcar 744 of outbound train 730 and railcar 740 of inbound train 722 are expected to be loaded and unloaded, respectively, at a location within threshold distance 710 of each other, DSRO system 160 and/or the hostler operations optimization system my determine that the start-point of the deramp operation is within the threshold distance of the end-point of the ramp operation. However, in response to a determination that railcar 744 of outbound train 730 and railcar 740 of inbound train 722 are expected to be loaded and unloaded, respectively, at a location not within threshold distance 710 of each other, DSRO system 160 and/or the hostler operations optimization system my determine that the start-point of the deramp operation is not within the threshold distance of the end-point of the ramp operation.

In embodiments, the hostler operations optimization system may, before pairing the deramp operation to the ramp operation at block 616, determine whether the pairing this ramp operations to this deramp operation yields a higher unit throughput over the planning horizon than the unit throughput obtain by pairing this ramp operations to another deramp operation in the same time increment. In these embodiments, the pairing may be performed after all potential candidate pairs have been determined for the current time increment.

In response to determining that the start-point of the deramp operation is not within the threshold distance of the end-point of the ramp operation, the hostler operations optimization system may, at block 620, determine whether there are other deramp operations in the current time increment that have not been analyzed to determine whether these deramp operations meet the threshold distance criteria with respect to the current ramp operation. In response to a determination, at block 620, that there are other deramp operations in the current time increment that have not been analyzed with respect to the current ramp operation, the hostler operations optimization system may, at block 610, obtain a next deramp operation and may continue the analysis as described with respect to block 612. This step ensures that all potential deramp operations are considered for pairing with the ramp operation.

However, in response to a determination, at block 620, that there are no other deramp operations in the current time increment that have not been analyzed with respect to the current ramp operation, the hostler operations optimization system may, at block 622, determine whether there are other ramp operations in the current time increment that have not been analyzed. In response to a determination, at block 622, that there are other ramp operations in the current time increment that have not been analyzed, the hostler operations optimization system may, at block 606, obtain a next ramp operation and may continue the analysis as described with respect to block 608. This step ensures that all potential ramp operations are considered for pairing with a deramp operation.

However, in response to a determination, at block 622, that there are no other ramp operations in the current time increment that have not been analyzed, the hostler operations optimization system may, at block 624, determine whether there are other time increments in the planning horizon of the optimized operating schedule being generated. In response to a determination, at block 624, that there are other time increments in the planning horizon of the optimized operating schedule being generated, the hostler operations optimization system may, at block 604, obtain a next time increment and may continue the analysis as described with respect to block 606. This step ensures that the optimization process is carried out for the complete planning horizon.

However, in response to a determination, at block 624, that there are no other time increments in the planning horizon of the optimized operating schedule being generated, the hostler operations optimization system may, at block 626, include the generated ramp/deramp pairs for each time increment in the planning horizon into the optimized operating schedule. The optimized operating schedule may be sent to operations server 125 for storage and subsequent execution. This final step is pivotal in creating an optimized operating schedule that maximizes the utilization of hostler resources and increases the unit throughput of the hub. Operations end at block 628.

It is noted that a deramp/ramp pairs includes hostler operations in which a deramp operation is performed first, followed by a ramp operation. In this case, the deramp operation terminates at the deramp end-point, and the ramp operation begins at a ramp start point. Once the hostler finishes the deramp operation, the hostler drives directly from the deramp end-point to the ramp start-point to begin the ramp operation in the deramp/ramp pair. A ramp/deramp pairs includes hostler operations in which a ramp operation is performed first, followed by a deramp operation. In this case, the ramp operation terminates at the ramp end-point, and the deramp operation begins at a deramp start point. Once the hostler finishes the ramp operation, the hostler drives directly from the ramp end-point to the deramp start-point to begin the deramp operation in the ramp/deramp pair.

Figure 8:
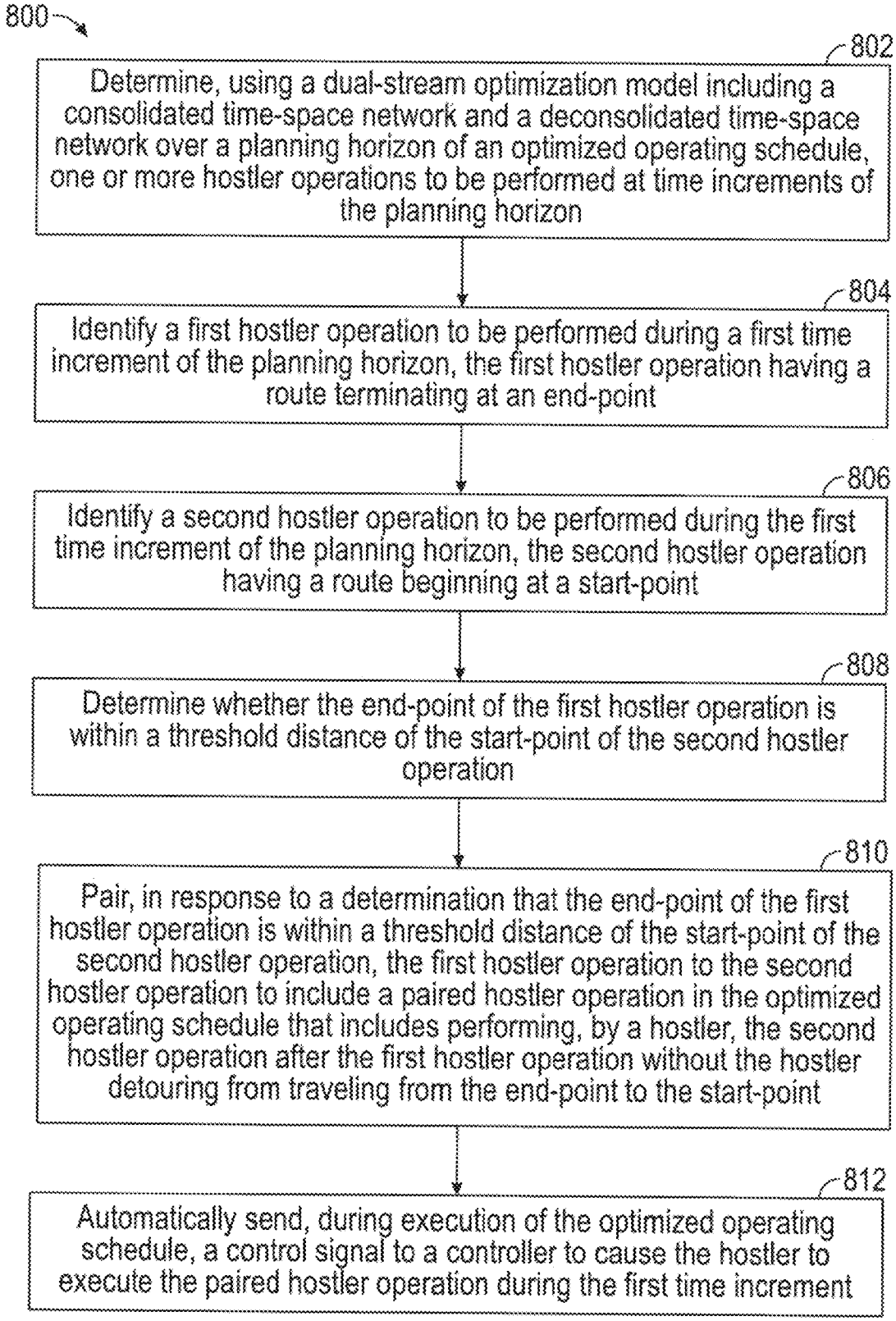
FIG. 8 shows a high-level flow diagram of operation of a system configured for providing functionality for intelligently managing hostler operations to optimize operating schedules associated with a hub in accordance with embodiments of the present disclosure.

FIG. 8 shows a high-level flow diagram 800 of operation of a system configured for providing functionality for intelligently managing hostler operations to optimize operating schedules associated with a hub in accordance with embodiments of the present disclosure. For example, the functions illustrated in the example blocks shown in FIG. 8 may be performed by system 100 of FIG. 1 according to embodiments herein. In embodiments, the operations of the method 800 may be stored as instructions that, when executed by one or more processors, cause the one or more processors to perform the operations of the method 800.

At block 802, one or more hostler operations to be performed at time increments of the planning horizon are determined using a dual-stream optimization model including a consolidated time-space network and a deconsolidated time-space network over a planning horizon of an optimized operating schedule. In embodiments, functionality of a DSRO system (e.g., DSRO system 160 as illustrated in FIGS. 1 and 2) may be used to determine, using a dual-stream optimization model including a consolidated time-space network and a deconsolidated time-space network over a planning horizon of an optimized operating schedule, one or more hostler operations to be performed at time increments of the planning horizon. In embodiments, the DSRO system may perform operations to used to determine, using a dual-stream optimization model including a consolidated time-space network and a deconsolidated time-space network over a planning horizon of an optimized operating schedule, one or more hostler operations to be performed at time increments of the planning horizon according to operations and functionality as described above with reference to DSRO system 160 and as illustrated in FIGS. 1-7.

At block 804, a first hostler operation to be performed during a first time increment of the planning horizon is identified. In embodiments, the first hostler operation may have a route terminating at an end-point. In embodiments, functionality of a pairing determination manager (e.g., pairing determination manager 322 as illustrated in FIG. 3) may be used to identify a first hostler operation to be performed during a first time increment of the planning horizon. In embodiments, the pairing determination manager may perform operations to identify a first hostler operation to be performed during a first time increment of the planning horizon according to operations and functionality as described above with reference to pairing determination manager 322 and as illustrated in FIGS. 1-7.

At block 806, a second hostler operation to be performed during the first time increment of the planning horizon is identified. In embodiments, the second hostler operation may have a route beginning at a start-point. In embodiments, functionality of a pairing determination manager (e.g., pairing determination manager 322 as illustrated in FIG. 3) may be used to identify a second hostler operation to be performed during the first time increment of the planning horizon. In embodiments, the pairing determination manager may perform operations to identify a second hostler operation to be performed during the first time increment of the planning horizon according to operations and functionality as described above with reference to pairing determination manager 322 and as illustrated in FIGS. 1-7.

At block 808, a determination is made as to whether the end-point of the first hostler operation is within a threshold distance of the start-point of the second hostler operation. In embodiments, functionality of a pairing determination manager (e.g., pairing determination manager 322 as illustrated in FIG. 3) may be used to determine whether the end-point of the first hostler operation is within a threshold distance of the start-point of the second hostler operation. In embodiments, the pairing determination manager may perform operations to determine whether the end-point of the first hostler operation is within a threshold distance of the start-point of the second hostler operation according to operations and functionality as described above with reference to pairing determination manager 322 and as illustrated in FIGS. 1-7.

At block 810, the first hostler operation is paired to the second hostler operation to include a paired hostler operation in the optimized operating schedule that includes performing, by a hostler, the second hostler operation after the first hostler operation without the hostler detouring from traveling from the end-point to the start-point, in response to a determination that the end-point of the first hostler operation is within a threshold distance of the start-point of the second hostler operation. In embodiments, functionality of a pairing determination manager (e.g., pairing determination manager 322 as illustrated in FIG. 3) may be used to pair, in response to a determination that the end-point of the first hostler operation is within a threshold distance of the start-point of the second hostler operation, the first hostler operation to the second hostler operation to include a paired hostler operation in the optimized operating schedule that includes performing, by a hostler, the second hostler operation after the first hostler operation without the hostler detouring from traveling from the end-point to the start-point. In embodiments, the pairing determination manager may perform operations to pair, in response to a determination that the end-point of the first hostler operation is within a threshold distance of the start-point of the second hostler operation, the first hostler operation to the second hostler operation to include a paired hostler operation in the optimized operating schedule that includes performing, by a hostler, the second hostler operation after the first hostler operation without the hostler detouring from traveling from the end-point to the start-point according to operations and functionality as described above with reference to pairing determination manager 322 and as illustrated in FIGS. 1-7.

At block 812, a control signal is automatically sent to a controller to cause the hostler to execute the paired hostler operation during the first time increment. In embodiments, functionality of an operations server (e.g., operations server 125 as illustrated in FIGS. 1-3) may be used automatically send, during execution of the optimized operating schedule, a control signal to a controller to cause the hostler to execute the paired hostler operation during the first time increment. In embodiments, the operations server may perform operations to automatically send, during execution of the optimized operating schedule, a control signal to a controller to cause the hostler to execute the paired hostler operation during the first time increment according to operations and functionality as described above with reference to operations server 125 and as illustrated in FIGS. 1-7.

Persons skilled in the art will readily understand that advantages and objectives described above would not be possible without the particular combination of computer hardware and other structural components and mechanisms assembled in this inventive system and described herein. Additionally, the algorithms, methods, and processes disclosed herein improve and transform any general-purpose computer or processor disclosed in this specification and drawings into a special purpose computer programmed to perform the disclosed algorithms, methods, and processes to achieve the aforementioned functionality, advantages, and objectives. It will be further understood that a variety of programming tools, known to persons skilled in the art, are available for generating and implementing the features and operations described in the foregoing. Moreover, the particular choice of programming tool(s) may be governed by the specific objectives and constraints placed on the implementation selected for realizing the concepts set forth herein and in the appended claims.

The description in this patent document should not be read as implying that any particular element, step, or function can be an essential or critical element that must be included in the claim scope. Also, none of the claims can be intended to invoke 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," "processing device," or "controller" within a claim can be understood and intended to refer to structures known to those skilled in the relevant art, as further modified or enhanced by the features of the claims themselves, and can be not intended to invoke 35 U.S.C. § 112(f). Even under the broadest reasonable interpretation, in light of this paragraph of this specification, the claims are not intended to invoke 35 U.S.C. § 112(f) absent the specific language described above.

The disclosure may be embodied in other specific forms without departing from the spirit or essential characteristics thereof. For example, each of the new structures described herein, may be modified to suit particular local variations or requirements while retaining their basic configurations or structural relationships with each other or while performing the same or similar functions described herein. The present embodiments are therefore to be considered in all respects as illustrative and not restrictive. Accordingly, the scope of the disclosure can be established by the appended claims. All changes which come within the meaning and range of equivalency of the claims are therefore intended to be embraced therein. Further, the individual elements of the claims are not well-understood, routine, or conventional. Instead, the claims are directed to the unconventional inventive concept described in the specification.

Those of skill in the art would further appreciate that the various illustrative logical blocks, modules, circuits, and algorithm steps described in connection with the disclosure herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present disclosure. Skilled artisans will also readily recognize that the order or combination of components, methods, or interactions that are described herein are merely examples and that the components, methods, or interactions of the various embodiments of the present disclosure may be combined or performed in ways other than those illustrated and described herein.

Functional blocks and modules in FIGS. 1-8 may comprise processors, electronics devices, hardware devices, electronics components, logical circuits, memories, software codes, firmware codes, etc., or any combination thereof. Consistent with the foregoing, various illustrative logical blocks, modules, and circuits described in connection with the disclosure herein may be implemented or performed with a general-purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices, e.g., a combination of a DSP and a microprocessor, a plurality of microprocessors, one or more microprocessors in conjunction with a DSP core, or any other such configuration.

The steps of a method or algorithm described in connection with the disclosure herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to the processor such that the processor can read information from, and write information to, the storage medium. In the alternative, the storage medium may be integral to the processor. The processor and the storage medium may reside in an ASIC. The ASIC may reside in a user terminal, base station, a sensor, or any other communication device. In the alternative, the processor and the storage medium may reside as discrete components in a user terminal.

In one or more exemplary designs, the functions described may be implemented in hardware, software, firmware, or any combination thereof. If implemented in software, the functions may be stored on or transmitted over as one or more instructions or code on a computer-readable medium. Computer-readable media includes both computer storage media and communication media including any medium that facilitates transfer of a computer program from one place to another. Computer-readable storage media may be any available media that can be accessed by a general purpose or special purpose computer. By way of example, and not limitation, such computer-readable media can comprise RAM, ROM, EEPROM, CD-ROM or other optical disk storage, magnetic disk storage or other magnetic storage devices, or any other medium that can be used to carry or store desired program code means in the form of instructions or data structures and that can be accessed by a general-purpose or special-purpose computer, or a general-purpose or special-purpose processor. Also, a connection may be properly termed a computer-readable medium. For example, if the software is transmitted from a website, server, or other remote source using a coaxial cable, fiber optic cable, twisted pair, or digital subscriber line (DSL), then the coaxial cable, fiber optic cable, twisted pair, or DSL, are included in the definition of medium. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media.

Although the present disclosure and its advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods, and steps described in the specification. As one of ordinary skill in the art will readily appreciate from the disclosure of the present disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A method of optimizing utilization of hostler resources associated with a hub, comprising:

determining, using a dual-stream optimization model including a consolidated time-space network and a deconsolidated time-space network over a planning horizon of an optimized operating schedule, one or more hostler operations to be performed at time increments of the planning horizon;

identifying a first hostler operation to be performed during a first time increment of the planning horizon, the first hostler operation having a route terminating at an end-point;

identifying a second hostler operation to be performed during the first time increment of the planning horizon, the second hostler operation having a route beginning at a start-point;

determining whether the end-point of the first hostler operation is within a threshold distance of the start-point of the second hostler operation;

pairing, in response to a determination that the end-point of the first hostler operation is within a threshold distance of the start-point of the second hostler operation, the first hostler operation to the second hostler operation to include a paired hostler operation in the optimized operating schedule that includes performing, by a hostler, the second hostler operation after the first hostler operation without the hostler detouring from traveling from the end-point to the start-point; and automatically sending, during execution of the optimized operating schedule, a control signal to a controller to cause the hostler to execute the paired hostler operation during the first time increment.

2. The method of claim 1, wherein determining whether the end-point of the first hostler operation is within the threshold distance of the start-point of the second hostler operation includes:

determining whether the end-point of the first hostler operation and the start-point of the second hostler operation are in the same parking lot.

3. The method of claim 1, wherein determining whether the end-point of the first hostler operation is within the threshold distance of the start-point of the second hostler operation includes:

determining that the end-point of the first hostler operation is a first parking spot and the start-point of the second hostler operation is a second parking spot; and determining whether the first parking spot is within the threshold distance of the second parking spot.

4. The method of claim 1, wherein determining whether the end-point of the first hostler operation is within the threshold distance of the start-point of the second hostler operation includes:

determining that the end-point of the first hostler operation is a railcar of an outgoing train and the start-point of the second hostler operation is a railcar of an inbound train; and determining whether the railcar of the outgoing train is within the threshold distance of the railcar of the inbound train.

5. The method of claim 1, wherein the threshold distance is determined based on a predefined maximum travel distance that a hostler can cover within a specific time frame to ensure timely execution of the paired hostler operation.

6. The method of claim 1, further comprising:

monitoring the execution of the paired hostler operation to verify that the hostler does not deviate from the direct path between the end-point of the first hostler operation and the start-point of the second hostler operation.

7. The method of claim 1, wherein the control signal includes instructions for the hostler to perform additional tasks between the completion of the first hostler operation and the commencement of the second hostler operation if the end-point and the start-point are not within the threshold distance.

8. The method of claim 1, wherein the optimized operating schedule is dynamically updated based on real-time tracking of hostler locations and availability to accommodate changes in the hub's operational requirements.

9. The method of claim 1, wherein the optimized operating schedule includes prioritization of hostler operations based on the urgency of unit movements, with the paired hostler operation receiving a higher priority when the end-point and the start-point are within the threshold distance.

10. A system configured for optimizing utilization of hostler resources associated with a hub, comprising:

at least one processor; and a memory operably coupled to the at least one processor and storing processor-readable code that, when executed by the at least one processor, is configured to perform operations including:

determining, using a dual-stream optimization model including a consolidated time-space network and a deconsolidated time-space network over a planning horizon of an optimized operating schedule, one or more hostler operations to be performed at time increments of the planning horizon;

identifying a first hostler operation to be performed during a first time increment of the planning horizon, the first hostler operation having a route terminating at an end-point;

identifying a second hostler operation to be performed during the first time increment of the planning horizon, the second hostler operation having a route beginning at a start-point;

determining whether the end-point of the first hostler operation is within a threshold distance of the start-point of the second hostler operation;

pairing, in response to a determination that the end-point of the first hostler operation is within a threshold distance of the start-point of the second hostler operation, the first hostler operation to the second hostler operation to include a paired hostler operation in the optimized operating schedule that includes performing, by a hostler, the second hostler operation after the first hostler operation without the hostler detouring from traveling from the end-point to the start-point; and automatically sending, during execution of the optimized operating schedule, a control signal to a controller to cause the hostler to execute the paired hostler operation during the first time increment.

11. The system of claim 10, wherein determining whether the end-point of the first hostler operation is within the threshold distance of the start-point of the second hostler operation includes:

determining whether the end-point of the first hostler operation and the start-point of the second hostler operation are in the same parking lot.

12. The system of claim 10, wherein determining whether the end-point of the first hostler operation is within the threshold distance of the start-point of the second hostler operation includes:

determining that the end-point of the first hostler operation is a first parking spot and the start-point of the second hostler operation is a second parking spot; and determining whether the first parking spot is within the threshold distance of the second parking spot.

13. The system of claim 10, wherein determining whether the end-point of the first hostler operation is within the threshold distance of the start-point of the second hostler operation includes:

determining that the end-point of the first hostler operation is a railcar of an outgoing train and the start-point of the second hostler operation is a railcar of an inbound train; and determining whether the railcar of the outgoing train is within the threshold distance of the railcar of the inbound train.

14. The system of claim 10, wherein the threshold distance is determined based on a predefined maximum travel distance that a hostler can cover within a specific time frame to ensure timely execution of the paired hostler operation.

15. The system of claim 10, wherein the operations further comprise:

monitoring the execution of the paired hostler operation to verify that the hostler does not deviate from the direct path between the end-point of the first hostler operation and the start-point of the second hostler operation.

16. The system of claim 10, wherein the control signal includes instructions for the hostler to perform additional tasks between the completion of the first hostler operation and the commencement of the second hostler operation if the end-point and the start-point are not within the threshold distance.

17. The system of claim 10, wherein the optimized operating schedule is dynamically updated based on real-time tracking of hostler locations and availability to accommodate changes in the hub's operational requirements.

18. The system of claim 10, wherein the optimized operating schedule includes prioritization of hostler operations based on the urgency of unit movements, with the paired hostler operation receiving a higher priority when the end-point and the start-point are within the threshold distance.

19. A computer-based tool for optimizing utilization of hostler resources associated with a hub, the computer-based tool including non-transitory computer readable media having stored thereon computer code which, when executed by a processor, causes a computing device to perform operations comprising:

determining, using a dual-stream optimization model including a consolidated time-space network and a deconsolidated time-space network over a planning horizon of an optimized operating schedule, one or more hostler operations to be performed at time increments of the planning horizon;

identifying a first hostler operation to be performed during a first time increment of the planning horizon, the first hostler operation having a route terminating at an end-point;

identifying a second hostler operation to be performed during the first time increment of the planning horizon, the second hostler operation having a route beginning at a start-point;

determining whether the end-point of the first hostler operation is within a threshold distance of the start-point of the second hostler operation;

pairing, in response to a determination that the end-point of the first hostler operation is within a threshold distance of the start-point of the second hostler operation, the first hostler operation to the second hostler operation to include a paired hostler operation in the optimized operating schedule that includes performing, by a hostler, the second hostler operation after the first hostler operation without the hostler detouring from traveling from the end-point to the start-point; and automatically sending, during execution of the optimized operating schedule, a control signal to a controller to cause the hostler to execute the paired hostler operation during the first time increment.

20. The computer-based tool of claim 19, wherein determining whether the end-point of the first hostler operation is within the threshold distance of the start-point of the second hostler operation includes:

determining whether the end-point of the first hostler operation and the start-point of the second hostler operation are in the same parking lot.

* * * * *